US008058815B1

(12) United States Patent
Hardy

(10) Patent No.: US 8,058,815 B1
(45) Date of Patent: Nov. 15, 2011

(54) LED DRIVERS AND DRIVER CONTROLLERS

(75) Inventor: David J. Hardy, Howard City, MI (US)

(73) Assignee: Spectrum Illumination Co., Inc., Montague, MI (US)

( * ) Notice: Subject to any disclaimer, the term of this patent is extended or adjusted under 35 U.S.C. 154(b) by 839 days.

(21) Appl. No.: 12/129,181

(22) Filed: May 29, 2008

Related U.S. Application Data

(60) Provisional application No. 60/940,981, filed on May 31, 2007.

(51) Int. Cl.
*H05B 37/02* (2006.01)

(52) U.S. Cl. ..... 315/291; 315/294; 315/307; 315/308

(58) Field of Classification Search ..... 315/209 R, 315/224, 225, 241 P, 241 S, 245, 291, 294, 315/307, 308, 312, 360–362
See application file for complete search history.

(56) References Cited

U.S. PATENT DOCUMENTS

| | | | | |
|---|---|---|---|---|
| 7,307,385 | B2 * | 12/2007 | Yamamoto et al. | 315/224 |
| 7,492,108 | B2 * | 2/2009 | Garcia et al. | 315/291 |
| 2006/0273742 | A1 * | 12/2006 | Kim et al. | 315/308 |

OTHER PUBLICATIONS

LM3402/LM3402HV 0.5A Constant Current Buck Regulator for Driving High Power LEDs Datasheet, Oct. 2006.
LM3404/04HV 1.0A Constant Current Buck Regulator for Driving High Power LEDs Datasheet, Feb. 2007.
LM5642/LM5642X High Voltage, Dual Synchronous Buck Converter with Oscillator Synchronization Datasheet, Dec. 2006.
A LED driver electrical schematic dated Sep. 21, 2002 corresponding to a publicly available LED driver.
A LED driver electrical schematic dated Nov. 25, 2002 corresponding to a publicly available LED driver.
A LED driver electrical schematic dated Jul. 27, 2004 corresponding to a publicly available LED driver.
A LED driver electrical schematic dated Dec. 21, 2004 corresponding to a publicly available LED driver.
A LED driver electrical schematic dated Mar. 21, 2005 corresponding to a publicly available LED driver.
A LED driver electrical schematic dated Feb. 21, 2006 corresponding to a publicly available LED driver.
A LED driver electrical schematic dated Mar. 21, 2006 corresponding to a publicly available LED driver.
LM3402 and LM3404 High Power PSOP-8 Evaluation Board Datasheet, Oct. 2007.
8-Channel Source Drivers 2981 and 2982 Data Sheet, Allegro Microsystems, Inc., copyright 1977-2008.

(Continued)

*Primary Examiner* — Jacob Y Choi
*Assistant Examiner* — Jimmy Vu
(74) *Attorney, Agent, or Firm* — Warner Norcross & Judd LLP

(57) ABSTRACT

LED drivers and LED driver controllers are disclosed for controlling one or more high-intensity LEDs. The LED driver controllers may control one or more LED drivers in multiple different ways, including controlling on times, off times, delays, current levels, and other parameters. The LED drivers may have fast response times in which the LEDs are illuminated within microseconds after receiving a control signal. The LED drivers may also include other features, including a current boost for temporarily illuminating the LEDs at levels exceeding their maximum continuous current rating, as well as brightness controls for the LEDs, and other features. The LED drivers and/or LED driver controllers may be especially suitable for LEDs used to provide lighting for high-speed visions systems.

7 Claims, 18 Drawing Sheets

OTHER PUBLICATIONS

High Brightness LED Current Regulator, A6260 Data Sheet, Allegro Microsystems, Inc., copyright 2007-2008.

DABiC-5 8-Bit Serial Input Latched Sink Drivers, A6821 Data Sheet, Allegro Microsystems, Inc., copyright 2004-2005.

500mA Dual Channel Movie/Flash LED Driver, CA4134 Data Sheet, Catalyst Semiconductor, Inc., May 13, 2008.

350mA High Efficiency Step Down LED Driver, CAT4201 Data Sheet, Catalyst Semiconductor, Inc., Feb. 21, 2008.

6 Watt Boost LED Driver, CAT4240 Data Sheet, Catalyst Semiconductor, Inc., Nov. 6, 2007.

120mA High Efficiency White LED Driver, AP3152 Data Sheet, Diodes Incorporated, Nov. 2007.

Fan 2103-TinyBuck, 3A, 24V Input, Integrated Synchronous Buck Regulator Data Sheet, Fairchild Semiconductor, May 2008.

Fan 2106-TinyBuck, 6A, 24A Input, Integrated Synchronous Buck Regulator Data Sheet, Fairchild Semiconductor, May 2008.

LED controller IC BCR450, Small Signal Discretes Data Sheet, Infineon, Sep. 2007.

LED Buck Regulator Control IC, IRS254(0,1)(S)PbF Data Sheet No. PD60293, International Rectifier, Feb. 2, 2007.

8-Pin Synchronous PWM Controller, IRU3037/IRU3037A & (PbF), Data Sheet No. PD94173 revD, International Rectifier, Oct. 24, 2005.

Dual 1.3A White LED Step-Up Converters with Wide Dimming LT3486 Data Sheet, Linear Technology, 2008.

PWM LED Driver and Boost, Flyback and SEPIC Controller LTC3783 Data Sheet, Linear Technology, 2008.

* cited by examiner

| MB CONNECTOR PINS | PNP | NPN |
|---|---|---|
| CAMERA # 1 | | |
| 1 | ○ | |
| 2 | | ○ |
| CAMERA # 2 | | |
| 3 | ○ | |
| 4 | | ○ |

| TABLE 1 | | | | |
|---|---|---|---|---|
| Iled | R39 | (R16-R19) Rfb | 0-10V Rfb (R16-R19) | 0-10V R31 |
| 0.34 | 1.0 | 2.67K | 30.1K | 26.1K |
| 0.68 | 1.0 | 825 | 16.2K | 13.0K |
| 0.75 | 1.0 | 665 | 16.2K | 12.1K |
| 1.4 | 0.1 | 7.87K | 86.6K | 73.2K |
| 2.1 | 0.1 | 4.87K | 57.6K | 48.7K |
| 2.8 | 0.1 | 3.40K | 43.2K | 35.7K |
| 3.0 | 0.1 | 3.09K | 34.0K | 34.0K |

FIG. 19

LED DRIVERS AND DRIVER CONTROLLERS

CROSS-REFERENCE TO RELATED APPLICATIONS

This application claims priority to U.S. provisional application Ser. No. 60/940,981, filed May 31, 2007 by David J. Hardy entitled LED DRIVER AND DRIVER CONTROLLER, the complete disclosure of which is incorporated by reference herein.

BACKGROUND OF THE INVENTION

The present invention relates generally to high intensity light emitting diodes (LEDs), and more particularly to the drivers and driver controllers used for illuminating the LEDs.

High intensity LEDs are commonly used in industrial settings for supplying illumination to high-speed camera equipment that takes pictures of products. In such settings, it is common for an automated camera to take pictures of the products being manufactured or assembled, often as the product passes by one or more particular points on an assembly line. Such pictures are often analyzed by a computer to determine if there are any defects in the product.

For example, in a bottling plant, a camera may be arranged along the assembly line where it takes a digital picture of each bottle as it passes by. A computer may then be used to analyze the picture taken to determine a number of different qualities of the bottled product, such as the following: whether a cap was properly attached to the bottle, whether the bottle was filled to an appropriate level, whether a label was applied to the bottle properly, whether the bottle is cracked, and various other qualities.

In order for the computer to analyze the photographs, it is often desirable that the illumination provided to the camera be nearly uniform for all of the pictures taken by the camera. This uniformity in lighting helps prevent the computer from misinterpreting the photographs due to changed lighting conditions. It may also be desirable to shut the lights off during the time intervals between photographs so as to conserve energy.

These types of demands have helped foster the use of high intensity LEDs for industrial photography situations. Because high-intensity LEDs are better able to produce the same amount of illumination over their lifetime, as compared to incandescent or fluorescent lighting, they are desirable for providing illumination in situations where constant levels of illumination are desired. Further, because high-intensity LEDs can be rapidly turned on and off and have favorable lifetimes relative to incandescent or fluorescent lighting, they are often used in high-speed photography situations.

Existing drivers for high-intensity LEDs, however, have suffered from several drawbacks. In some instances, the drivers powering the LEDs may not be able to turn the LEDs on in as fast as a time as would be desirable. In other instances, the current supplied to the LEDs by the driver does not stabilize for an undesirably long amount of time, thereby causing the illumination provided by the LEDs to fluctuate for the same amount of time. In some situations it is desirable to generate more illumination than the LEDs are rated to safely provide at continuous levels. Still further, in other situations it is not easy to set up and control the LED drivers in the particular ways demanded for a particular application.

SUMMARY OF THE INVENTION

The present invention provides both improved LED drivers and improved LED driver controls that address the drawbacks discussed above, as well as other disadvantages of prior LED drivers and LED driver controllers. The improved LED drivers of the present invention offer fast response times, extra illumination, and stabilized outputs. The improved LED driver controllers of the present invention offer easy methods and systems for configuring and controlling multiple LED drivers.

According to one aspect of the present invention, an LED control unit for controlling at least one LED driver is provided. The control unit includes a housing, an input, a first output, a controller, and a network port, such as, but not necessarily limited to, an Ethernet port. The input is adapted to receive a timing signal that includes a detectable voltage transition. The first output is adapted to output a first control signal for controlling a first LED driver. The controller is adapted to allow a first delay to be programmed into it whereby, when the controller detects the voltage transition in the timing signal, the controller outputs the first control signal after waiting for a time period equal to the first delay. The network port is electrically coupled to the controller and allows a personal computer to be operably coupled to the network port so that the personal computer can be used to program the time of the first delay into the controller.

According to another aspect of the present invention, an LED driver for driving at least one LED is provided where the LED has a forward current rating and a surge rating. The forward current rating identifies a maximum amount of current that can continuously run through the LED without damaging the LED, and the surge rating identifies a higher amount of current that can run through the LED for a specified amount of time before the LED may be damaged. The LED driver further comprises a constant current regulating circuit, a strobe circuit, and a current boosting circuit. The constant current regulating circuit controls a current to a substantially constant level at an output that is adapted to be coupled directly to one or more LEDs. The strobe circuit controls the constant current regulating circuit such that the constant current regulating circuit sets a constant non-zero current at the output when the strobe circuit detects a change in voltage at its input. The current boosting circuit is adapted to override the constant current regulating circuit and change the constant current at the output by elevating it to a value above the forward current rating for a first period of time no greater than the specified amount of time, and then lowering the current at the output to a non-zero value no greater than the forward current rating for a second period of time.

According to another aspect of the present invention, an LED driver for driving at least one LED is provided wherein the driver includes a buck converter circuit, a strobe circuit, and a voltage output limiting circuit. The buck converter circuit sets a constant current at an output adapted to be coupled directly to one or more LEDs. The strobe circuit controls the buck converter circuit such that the buck converter circuit sets a constant current at the output when the strobe circuit detects a change in voltage at its input. The voltage output limiting circuit is electrically coupled to the buck converter circuit and limits the voltage set by the buck converter circuit at the output.

According to yet another aspect of the present invention, an LED driver for driving at least one LED is provided. The LED driver includes a constant current buck regulator incorporated onto an integrated circuit substrate having at least two pins wherein a first one of the pins turns on and off the constant current buck regulator and a second one of the pins is adapted to be able to control the brightness of the at least one LED using a pulse-width modulated signal. The LED driver further includes a strobe input electrically coupled to the second pin wherein the LED driver turns the at least one LED on and off based on a strobe signal received at the second pin. The strobe signal is generated based on a signal from a camera.

According to still other aspects of the present invention, the control unit for controlling at least one LED driver may be programmable by coupling it to a personal computer. The control unit may be configured to allow changes to be made to its control parameters without the necessity of loading software onto the personal computer that is specific to the control unit. The control unit may also be programmed to allow additional parameters to be changed and set, such as a pulse number, an on time, an off time, a current level, and a product identification code. The control unit may be used to control a plurality of different LED drivers wherein the parameters used for controlling each of the LED drivers may be different for each LED driver.

In summary, the various LED drivers and driver control units of the present invention provide an improved method and system for controlling high intensity LEDs, offering easy-to-use control features, reliable operation, adjustability, easy set-up, and fast response times. These and other benefits of the present invention will be apparent to one skilled in the art in light of the following description and the accompanying drawings.

BRIEF DESCRIPTION OF THE FIGURES

FIG. 19 is a chart of various resistor values that can be implemented to change the current supplied to the LEDs by the LED driver of FIGS. 17A and 17B.

DETAILED DESCRIPTION OF THE INVENTION

Figure 1:
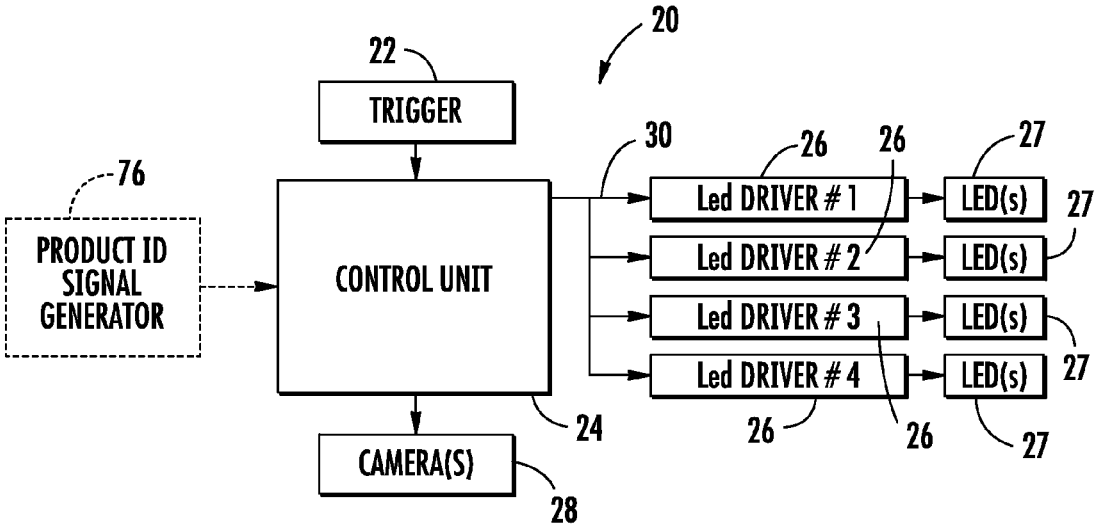
FIG. 1 is schematic diagram of a first possible arrangement of a control unit and a plurality of LED drivers according to the present invention.

The present invention will now be described in more detail wherein the reference numerals appearing in the following written description correspond to like-numbered elements in the accompanying drawings. An LED control system 20 according to a first aspect of the present invention is depicted in block diagram form in FIG. 1. LED control system 20 includes a trigger 22, a control unit 24, a plurality of LED drivers 26 (four are illustrated in FIG. 1, although more or less can be used in accordance with the present invention), one or more cameras 28, and a bus 30 electrically coupling the control unit 24 to the plurality of LED drivers 26. The LED control system 20 depicted in FIG. 1 is used to control the illumination of one or more LEDs 27 attached to each of the LED drivers 26. Typically, when the LEDs 27 are being used to provide illumination for one or more cameras, it may be desirable to flash or strobe the LEDs 27 on and off so that, between pictures, the LEDs 27 are not illuminated. Control system 20 is not only capable of precisely turning on and off the LEDs 27 connected to LED drivers 26, but it is also capable of controlling the amount of current supplied to the LEDs 27, the length of time the LEDs 27 are illuminated, the length of time the LEDs 27 are turned off, and any desirable time delay between the moment control unit 24 receives an input from trigger 22 and the moment control unit 24 outputs a "turn on" signal to one or more of the LED drivers 26, which respond by turning on the LEDs 27 electrically coupled thereto.

In control system 20, the precise timing for illuminating the LEDs 27 connected to the LED drivers 26 is based on a signal supplied by trigger 22 to control unit 24. Trigger 22 may come from a programmable logic controller (PLC), a sensor (such as one used to sense product traveling down an assembly or conveyor line), a computer, a camera, or some other electronic device. The precise source of the signal from trigger 22 is not limited by the present invention, but can come from any device that outputs a timing signal that forms the basis for determining when to illuminate one or more LEDs 27. The precise nature of the timing signal from trigger 22 can vary within the present invention as well. In its simplest form, the timing signal is a voltage transition from a recognized high level to a recognized low level, or vice versa.

Based on the timing signal received from trigger 22, control unit 24 will instruct one or more LED drivers 26 to illuminate their associated LEDs 27 at specific time, for a specific duration, and at a specific brightness level. These instructions are communicated to the LED driver(s) 26 via bus 30. Control unit 24 may also send a timing signal to one or more cameras 28 (via a direct connection) telling the one or more cameras 28 when to take a photograph. The precise nature of the timing signal can vary within the scope of the invention, but in its simplest form comprises a voltage transition from a high to a low level, or vice versa, which, when the camera detects the transition, signals the camera to snap a picture (either immediately after the detected transition, or after a particular delay after the detected transition). Control unit 24 can thus be configured to control the timing of both cameras 28 and the LEDs 27 that provide illumination for the photographs being taken.

Figure 2:
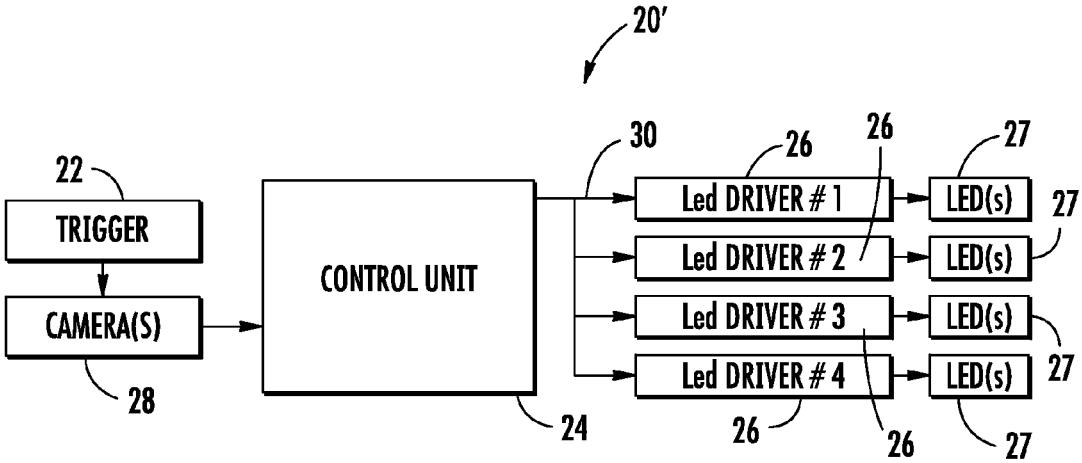
FIG. 2 is a schematic diagram of a second possible arrangement of a control unit and a plurality of LED drivers according to the present invention.

FIG. 2 illustrates an alternative arrangement of a control system 20' according to another aspect of the present invention. In control system 20', trigger 22 is supplied directly to camera 28, which then supplies a timing signal to control unit 24. Control unit 24 then outputs a signal on bus 30 to one or more LED drivers 26 telling them how and when to illuminate their connected LEDs 27. In the arrangement of FIG. 2, camera 28 includes the ability to delay the taking of a photograph after receiving the timing signal from trigger 22. This delay allows the camera to output a timing signal to control unit 24 and to wait while control unit 24 and LED drivers 26 turn on the desired LEDs 27. Camera 28 in FIG. 1 may also be set to delay taking a picture a specified amount of time after receiving the trigger signal from trigger 22.

In an alternative arrangement (not shown), control system 20 of the present invention may be modified by removing control unit 24 and tying the output of either trigger 22, or camera 28, directly to one or more of the LED drivers 26. While this may reduce the ease of control over the illumination of the LEDs 27, such a reduction in control may be entirely suitable for particular applications.

In some industrial or manufacturing applications it is desirable to take up to five thousand pictures per minute, or more. Using the LED drivers 26 of the present invention (either with or without control unit 24) allows for the precise strobing of the LEDs 27 at such rates. Indeed, some embodiments of the present invention may be strobed up to 10,000 times a second. Further, using the LED drivers 26 of the present invention allows for the fast turn on of the LEDs 27 after the LED driver 26 receives a signal to illuminate its respective LEDs, either from control unit 24, or directly from another source, such as camera 28 or trigger 22. Indeed, in one embodiment, an LED driver 26 according to the present invention is capable of turning on its associated LEDs 27 within about 4 microseconds after receiving an illumination signal.

Figure 3:
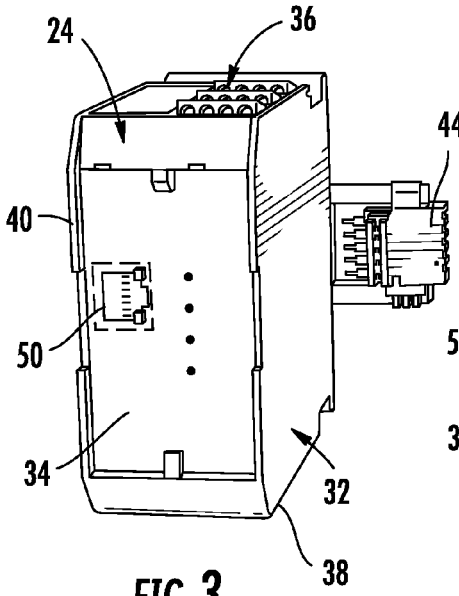
FIG. 3 is a front view of a control unit according to one aspect of the present invention.
Figure 4:
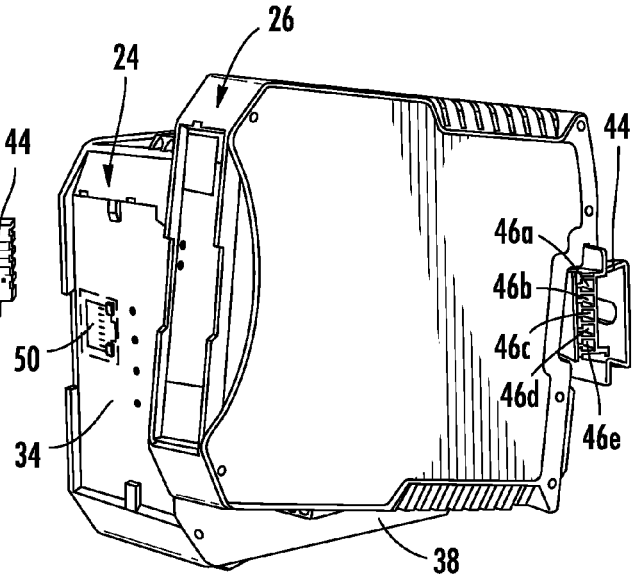
FIG. 4 is a side view of the control unit of FIG. 3 illustrated in conjunction with an LED driver.

Control unit 24 may be contained within a housing, such as the housing 32 depicted in FIG. 3. Housing 32 includes a front 34, a top 36, a bottom 38, two sides 40, and a back 42. Back 42 further includes a DIN rail connector 44 that extends outwardly from back 42 towards one of sides 40. DIN rail connector 44 provides the physical connections for coupling bus 30 between control unit 24 and the LED drivers 26. As shown in FIG. 4, DIN rail connector 44 may be physically coupled to the back side of an LED driver 26. This physical coupling also electrically couples control unit 24 to LED driver 26. Additional LED drivers 26 may also be physically and electrically coupled alongside the LED driver 26 shown in FIG. 4 by using additional DIN rail connectors 44. Thus, a plurality of LED drivers 26 may be physically cascaded together in a side-by-side fashion alongside control unit 24.

Figure 15:
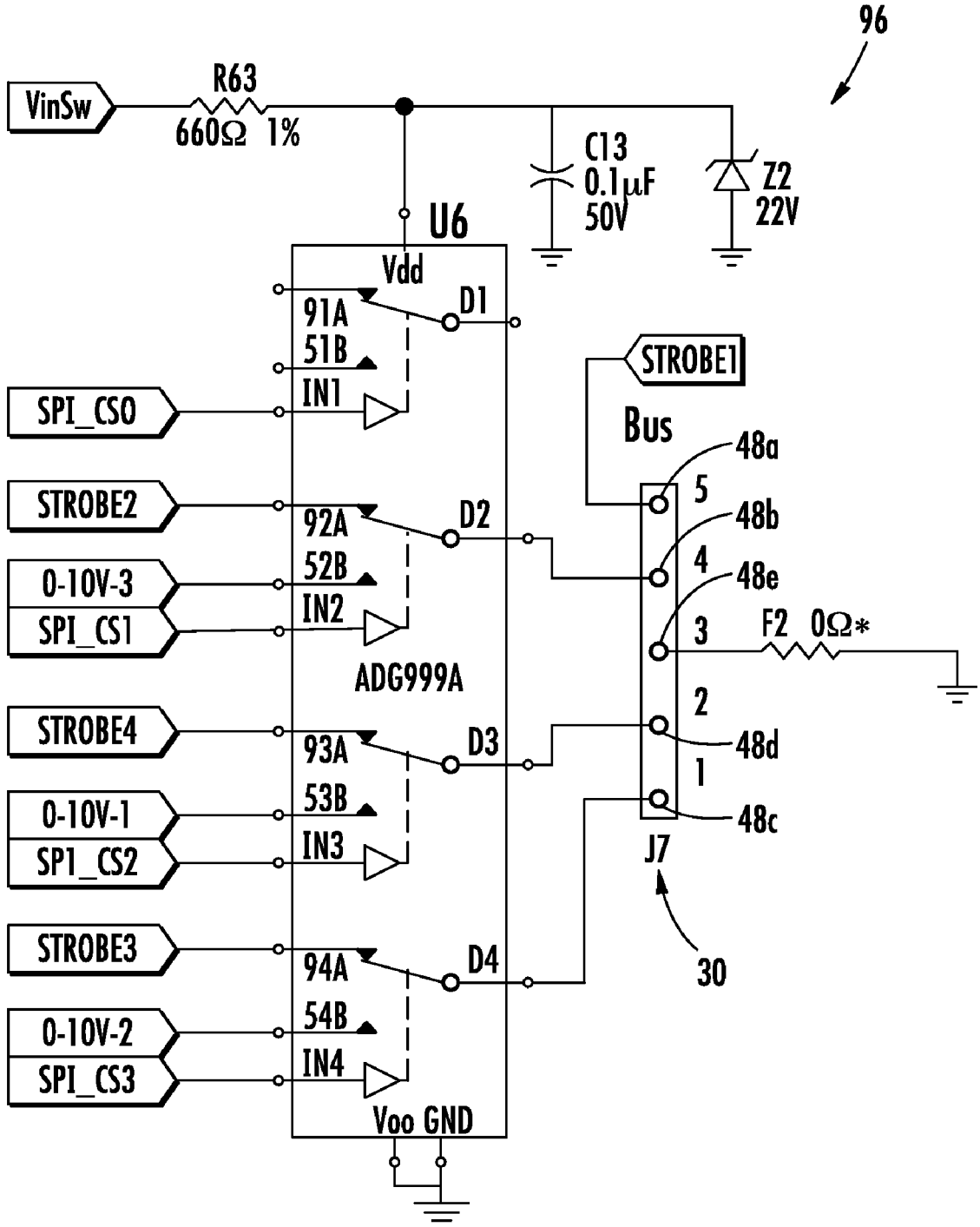
FIG. 15 is an electrical schematic of a bus output configuration circuit for the control unit of FIG. 3 wherein the bus output configuration circuit is electrically coupled to the circuit of FIG. 12.

As shown in FIG. 3, DIN rail connector 44 includes five electrical ports 46*a-e* which receive five mating pins (not illustrated) from an immediately adjacent LED driver 26. Each LED driver 26, in turn, includes five electrical ports 46*a-e* for receiving five mating pins from another immediately adjacent LED driver 26 (if there is another one present in the LED control system). Each port 46 is electrically coupled to a separate electrical line 48*a-e*, respectively (shown in FIG. 15). Together, the five electrical lines 48*a-e* make up bus 30. It will be understood by those skilled in the art, of course, that bus 30 can be made up of a greater or lesser number of electrical lines 48. By connecting the mating pins (not shown) of each LED driver 26 to the ports 46 of the next adjacent LED driver 26 (or control unit 24), all of the LED drivers 26 (and control unit 24) will be electrically coupled to the five lines 48*a-e* of bus 30. Signals sent by control unit 24 down any one of electrical lines 48*a-e* will thus be received by each LED driver 26 that has been coupled in a cascaded fashion to control unit 24.

The manner in which control unit 24 controls the LED drivers 26 coupled thereto is programmable. The programming of control unit 24 may be accomplished via a personal computer (not shown). In the embodiment shown in FIG. 3, housing 32 of control unit 24 includes an Ethernet port 50 for receiving an Ethernet cable. In order to program control unit 24, a Category 5, or higher, crossover cable is connected to Ethernet port 50 and a conventional personal computer (PC), which is not illustrated, and which includes its own Ethernet port. For purposes of this patent application, the term "personal computer" shall refer to both IBM®-compatible computers and Apple®-compatible computers, as well as other types of computers, regardless of operating system or manufacturer. It will be understood, of course, that other types of connections besides Ethernet connections may be used to couple a computer to control unit 24.

Control unit 24 is configured to include a built-in, default Internet Protocol (IP) address which, in one embodiment, may be 192.168.1.142. In order for the personal computer to communicate with control unit 24, the IP address of the personal computer may also be changed. In one embodiment, the IP address of the personal computer can be changed to 192.168.1.140 with a Subnet mask of 255.255.255.0 (if not the default). This can be easily accomplished on standard Microsoft Window®-based PCs through the Control Panel, Network Connection, and Local Area Connection Properties menus of Windows®. Control unit 24 can also be configured using different IP addresses, or different techniques beside an Ethernet coupling to a personal computer.

Control unit 24 includes memory and software contained within it that allow it to communicate with a personal computer without the need for loading specialized software onto the computer that is specific to control unit 24. In one embodiment, control unit 24 includes software configured to allow it to be accessed by the personal computer as if control unit 24 were a web-page. This enables a user to utilize a conventional web-browser, such as Internet Explorer®, Netscape Navigator®, etc. that typically comes pre-loaded onto the user's computer. The user therefore doesn't need to load any additional software onto his or her computer in order to be able to communicate with, and configure, control unit 24.

In order to communicate with control unit 24, the user of the personal computer types the IP address of control unit 24 into the web browser (after control unit 24 has been connected to the computer via the Ethernet cable). This will bring up a web-page that allows a user to enter the various parameters for controlling control unit 24. After the various parameters have been set and saved, the personal computer can be disconnected from control unit 24 and allowed to control the LED drivers 26 without any further control or communication with the personal computer.

Figure 8:
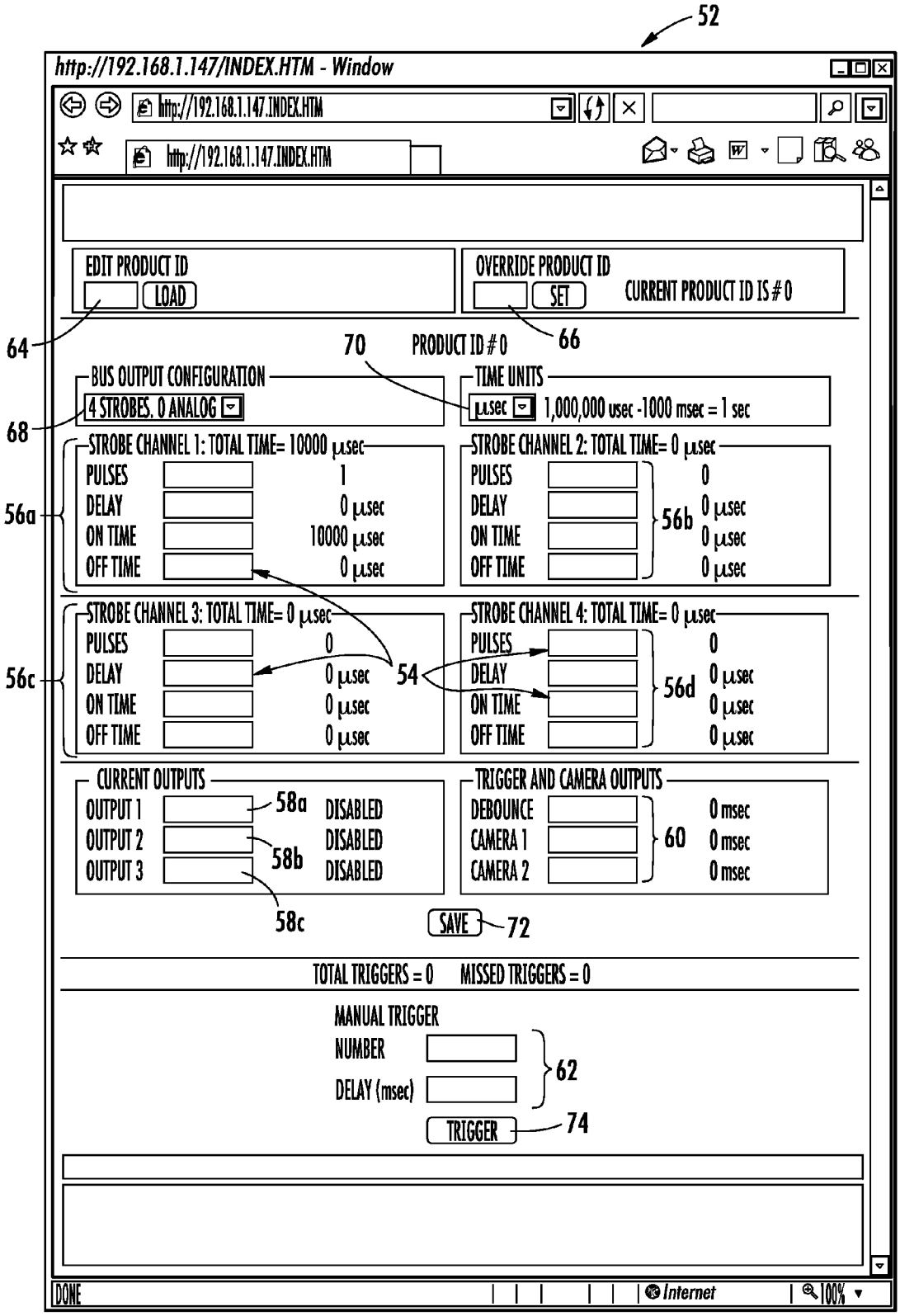
FIG. 8 is an illustrative screen shot of software that may be used to configure the control unit of FIG. 3.

FIG. 8 depicts an illustrative screen shot 52 of a web page that may be brought up by the computer after connecting to the IP address of control unit 24. The arrangement, layout, and functions available on screen shot 52 may, of course, be varied from that shown. As can be seen in FIG. 8, screen shot 52 includes a plurality of menus having data fields 54. The data fields 54 allow a user to enter information via the computer keyboard, mouse, or other input device. The data fields 54 are grouped into various combinations, such as a set of first groups 56*a-d* which allow for the setting of various parameters for four different strobe channels (1-4), a second group 58*a-c* which allows for the setting of up to three different current values for powering the LEDs 27 attached to three different LED drivers 26, a third group 60 that allows for setting the controls of up to two different cameras, and a fourth group 62 that allows an LED driver to be manually triggered with an optional amount of delay. Screen shot 52 also includes a product ID data field 64, an override product ID data field 66, a bus output configuration data field 68, and a time units 70 data field. Still further, screen shot 52 includes a save button 72 and a trigger button 74, either one of which is activated in a conventional way, such as by using a computer mouse to move the computer cursor over the button and then left clicking on the computer mouse. The function of these data fields and buttons will be described in more detail below.

Control unit 24 of FIGS. 1 and 2, as noted above, communicates with one or more LED drivers 26 via a bus 30 that is made up of five different electrical lines 48*a-e*. One of these electrical lines, 48*e*, is connected to an electrical ground. Another one of these electrical lines, 48*a*, is always used to control the switching on and off of LEDs 27 (i.e. strobing). The three remaining electrical lines, 48*b-d*, are available for either strobing LEDs 27 or for setting the current level that will be supplied to the LEDs 27 (and thus determine the intensity of their light). The user of control unit 24 has the option of deciding how these three electrical lines 48*b-d* will be used, either for strobing or intensity control, as will be discussed more below.

The strobing signals sent along electrical line 48*a* (and 48*b-d*, when applicable) can be varied in a number of different manners according to the user's needs. More specifically, the user has the option of setting various parameters that are identified in data fields 56*a-d*. For controlling the strobing signals transmitted along electrical line 48*a*, data fields 56*a* are used. For controlling the strobing signals transmitted along electrical lines 48*b, c* and *d* (if configured for strobing purposes, as discussed more below), data fields 56*b, c*, and *d*, respectively, are used. The various parameters are set by entering data into the data fields 56*a-d* (FIG. 8). As can be seen in FIG. 8, there are four strobe-related items of data that can be entered into the data field group 56. These include the number of pulses, the delay time, the on time, and the off time. The function of these four parameters will now be described with reference to data fields 56*a* and electrical line 48*a*.

The "Pulses" data field in first data field group 56*a* refers to the number of pulses that control unit 24 will output on electrical line 48*a* after the receipt of the timing signal from trigger 22, which, as noted above, may come from a variety of different sources. The "Pulses" data field in first group 56*a* thus allows multiple pulses to be transmitted on electrical line 48*a* after receiving only a single trigger input. Each of the pulses will cause any and all LED drivers 26 that are in electrical communication with line 48*a* (as described more below) to switch their associated LEDs 27 on and off in accordance with the pulses. Thus, the use of the "Pulses" data field in first group 56*a* allows a user to configure control unit 24 so that at least some lights (i.e. those driven by drivers 26 in electrical communication with electrical line 48*a*) will flash on and off multiple times in response to a single trigger input from trigger 22.

The "Delay" data field in first data field group 56*a* (FIG. 8) refers to the amount of time that control unit 24 will delay sending the pulse (or multiple pulses if a non-zero value is entered in the "Pulse" data field, as described above) on electrical line 48*a* after receiving the timing signal from trigger 22. In the example illustrated in FIG. 8, the units for this delay are set in values of microseconds. These units can be changed by selecting a different unit (e.g. milliseconds, seconds, etc.) using the time units data field 70. If the user enters the value 50, for example, into the "delay" data field in FIG. 8 (which is set for units of microseconds), then control unit 24 will delay 50 microseconds after receiving the timing signal from trigger 22 before outputting a pulse onto electrical line 48*a*. If more than one pulse has been entered into the "pulse" data field, then control unit 24 will wait 50 microseconds after receiving the timing signal from trigger 22 before outputting the number of pulses specified in the "pulse" data field. These series of pulses will thereafter be output consecutively; that is, each one will be output one after the other without any 50 microsecond delays in between them (the delay between the pulses in the series will be set by the "off time" data field, discussed more below).

The "On time" data field in first data field group 56*a* (FIG. 8) refers to the time length of each pulse. The pulses output by control unit 24 onto electrical line 48*a* are essentially pulse width modulated (PWM) signals where the width of the signal is determined by the "on time" data field. The width of the PWM signal is thus only modulated by the user's entry of a different value in the "on time" data field, or the control unit 24's detection of a different product identification signal that has a different stored "on time" (as will be discussed in more detail below). If a value of twenty microseconds, for example, is input into the "on time" data field, then control unit 24 will output (after the selected delay from the "delay" data field) on line 48*a* a pulse signal that goes high for twenty microseconds. Thereafter, the signal will go low. The minimum time at which it remains in the low condition is determined by the "off time" data field (FIG. 8). In some embodiments, the "off-time" data field may only be enabled if two or more pulses are entered into the "Pulse" field.

The "off time" data field in first data field group 56*a* (FIG. 8) refers to the time the pulse will remain low. In some embodiments, if control unit 24 is outputting only a single pulse on electrical line 48*a* in response to a timing signal from trigger 22 (i.e. the "pulses" data field is set to one), then the "off time" will be ignored. That is, two or more pulses must be specified in the "pulses" data field before the "off time" data field will be effective in some embodiments. If the "pulses" data field is set to a number greater than one, the "off time" will specify the amount of time between each of the pulses in the train of pulses output by control unit 24 onto electrical line 48*a*. After the last one of the pulses in the train is sent, control unit 24 will set the electrical line 48*a* to a low value for at least as long as the time specified in the "off time" data field. After that time period has passed, electrical line 48*a* will continue to stay low until control unit 24 receives another timing signal from trigger 22, at which point it will output a signal on electrical line 48*a* in accordance with the parameters set in first data field grouping 56*a* (including any delay signal). If control unit 24 receives a timing signal from trigger 22 prior to the expiration of the total pulse time and the "off time," it will ignore the timing signal and only respond to timing signals that occur after the expiration of the "off time." Further, it may provide an indication that a trigger was missed, such as via an illuminated error LED, or some other means.

In summary, data field grouping 56*a* (FIG. 8) allows a user to control the start time of a pulse or series of pulses (relative to trigger 22), the number of pulses, the width of each pulse, and the minimum time period between each pulse that is output onto electrical line 48*a*. The data field grouping 56*b* also includes the "pulses", "delay", "on time", and "off time" data fields which similarly allow for the control of the start time, number, width, and minimum off times of electrical line 48*b*. In other words, data field grouping 56*b* allows a user the same control over electrical line 48*b* as data field grouping 56*a* gives a user over electrical line 48*a* (as discussed above). Similarly, data field grouping 56*c* allows a user the same control over electrical line 48*c* as data field grouping 56*a* gives a user over electrical line 48*a*, and data field grouping 56*d* allows a user the same control over electrical line 48*d* as data field grouping 56*a* gives a user over electrical line 48*a*.

Screen shot 52, as mentioned above, also includes a second group of data fields 58*a-c* that allow for the adjustment of the value of the electrical current that is supplied to the LEDs 27 (and thus controls the intensity of their light). The value of the current that is entered into these "current output" data fields is specified as a percentage of the maximum allowable continuous current rating for the LEDs 27 connected to the LED drivers. As is known in the art, LEDs are rated according the maximum current that they can safely handle for continuous periods of time (sometimes referred to as the maximum forward continuous current rating). LEDs are also commonly rated according to a maximum amount of current that they can handle for a short, specified amount of time. This latter rating is higher than the former rating, thus allowing the LED to be safely driven at higher levels of current for limited and specified amounts of time. The "current output" data fields in groups 58*a-c* allow a user to set what percentage of the maximum forward continuous current rating he or she wishes the LEDs 27 to be driven at.

While the invention is broad enough to encompass the ability of control unit 24 to simultaneously control the current levels and strobing for any number of different LED drivers 26, the control unit 24 illustrated in FIGS. 3-5 and 12-16 is configured such that electrical lines 48*b-d* are dedicated to controlling either the strobing or the intensity of the LEDs 27, but not both at the same time. Thus, if a user enters a value into each of the three "current output" data fields 58*a-c* (FIG. 8), then electrical lines 48*b-d* will be dedicated to controlling LED intensity (electrical current) rather than strobing. Consequently, when values are specified in each of the three data fields 58*a-c*, the user cannot simultaneously enter valid data into any of the "pulses," "delay," "on time," or "off time" data fields in strobe channels 2, 3, or 4. Conversely, if the user enters data into one or more of the data fields in each of the data field groups 56*b, c*, and *d*, then electrical lines 48*b, c*, and *d* will be dedicated to controlling the strobing of the LEDs 27, and cannot be simultaneously used for controlling the intensity of the LEDs 27.

The user, however, can mix the strobing and the intensity control functions such that one or more of electrical lines 48*b-d* is used for strobing while the other electrical lines 48*b-d* are used for intensity control (as noted above, electrical line 48*a* is dedicated for use as strobing, and thus cannot be used to control intensity, regardless of how any of the other data fields are used or set). Thus, the user could dedicate electrical line 48*b* for use in strobing control while using electrical lines 48*c* and 48*d* for intensity control. Alternatively, electrical lines 48*b* and 48*c* could be used for strobing while electrical line 48*d* is used for intensity control. In sum, electrical lines 48*b-d* can be dedicated according to any combination of strobing and/or intensity control. To dedicate the particular control arrangement that is desired, the user simply accesses the bus output configuration data field 68 and selects the appropriate configuration, and then enters the desired settings into the appropriate first or second data field groups 56 and 58.

In addition to controlling the intensity and/or strobing of the LEDs 27, control unit 24 can also be used to control one or more cameras 28. This control is accomplished through the third group of data fields 60 illustrated in screen shot 52 (FIG. 8). As illustrated, the user is only able to control two different cameras (camera 1 and camera 2). However, the invention can be modified to allow for the control of more than two cameras, if desired. The specific control afforded the user by control unit 24 is the setting of a delay period. The delay period is the amount of time after control unit 24 receives a timing signal from trigger 22 before outputting a signal to the camera that triggers the camera to take a picture. This delay can be set to different values for each of the cameras. The setting of delay values for the cameras in data fields 60 is optional, as is the use of control unit 24 to control any cameras whatsoever. In other words, control unit 24 need not send any signals to any cameras, if desired, and the control of the cameras can be accomplished through other control structures, such as a PLC, a sensor, another camera, or other device. As was discussed previously, control system 20' depicted in FIG. 2 is configured such that control unit 24 does not control a camera, but instead receives its trigger from a camera.

Screen shot 52 also gives the user the option to enter a value into a "debounce" data field that is part of third group 60. The "debounce" data field is a time period that can be specified by the user during which time no additional trigger inputs will be responded to by control unit 24 after the receipt of a first timing signal from trigger 22. In other words, if a value of ten milliseconds is input into the "debounce" data field, control unit 24, upon receiving a timing signal from trigger 22, will not subsequently react to any addition timing signals supplied by trigger 22 prior to the passage of ten millisecond. Thus, the "debounce" field can be used to shield control unit 24 from triggering signals that may occur too quickly after the receipt of another prior trigger signal.

The user of control unit 24 also has the ability to test the parameters input via screen shot 52 by utilizing the fourth group of data fields 62. This fourth group of data fields 62 is labeled "manual trigger" in screen shot 52 and includes two specific data fields identified as "number" and "delay." The "number" data field allows the user to specify the number of times that control unit 24 will output control signals to the connected LED drivers (and/or cameras) after the user initiates the manual trigger. The "delay" channel allows the user to set a delay time which specifies the amount of time between each of the triggers specified in the "number" data field. After these two data fields are entered, the user can "push" the trigger button by these two data fields to manually trigger control unit 24. This manual triggering will cause control unit 24 to act as it would if it had received a trigger signal from trigger 22. In other words, control unit will respond by outputting the appropriate control signals at the appropriate times, based on the parameters set in data field groups 56, 58, 60, 68 and 70. If the user selects a number greater than 1 in the "number" data field, control unit 24 will automatically retrigger itself the specified number of times (after the delay specified in the "delay" data field). This manual triggering allows a user to test the configuration of control unit 24 while control unit 24 is still attached to a computer, and the "number" data field saves the user the trouble of having to manually "press" the trigger button 74 on screen shot 52 multiple times.

After the user has entered the desired parameters into the desired data fields shown on screen shot 52, the user can then store all of the entered parameters in a memory built into control unit 24. This is accomplished by "pushing" the save button 72 on screen shot 52 using the computer cursor and computer mouse. The user can also enter a product identification code into data field 64 which will then be saved along with the parameters entered into the other data fields (after "pressing" the save button 72). Further, multiple different sets of parameters can be entered and saved, each with a different product identification number. Still further, the multiple different sets of parameters can be retrieved for viewing and/or editing using the "edit product ID" data field. The number of different sets of data that can be stored can be increased as desired by including more memory in control unit 24.

The use of different product identification codes entered into product ID field 64 enables a user to control the LEDs 27 in different manners for different products. This may be especially useful if control unit 24 is being used to provide the illumination for photographs taken along an assembly line, conveyor line, or other industrial line in which different types of products pass. For different products, it may be desirable to alter the lighting provided by the LEDs 27, the timing of the lighting, the intensity of the lighting, as well as the number and/or duration of the pulses of light. This can all be easily accomplished by sending a product ID signal from a product ID signal generator 76 (FIG. 1) to control unit 24, which utilizes the product ID signal to call up the control parameters (i.e. those illustrated in screen shot 52) corresponding to that product ID from its memory and use those control parameters in controlling the LED drivers 26.

The product ID signal generator 76 is an optional component that is illustrated in FIG. 1 in dashed lines in order to emphasize its optionality. Control unit 24 can be used without a product ID signal generator 76, but in such cases changes to the control parameters of control unit 24 must be made by manually reconnecting control unit 24 to a personal computer via the Ethernet cable and accessing screen shot 52. When used in a particular control system, the product ID signal generator can be any of a variety of different devices, such as a sensor, a PLC, another computer, or any other device capable of outputting a signal identifying a product in accordance with the functions described herein.

Figure 5:
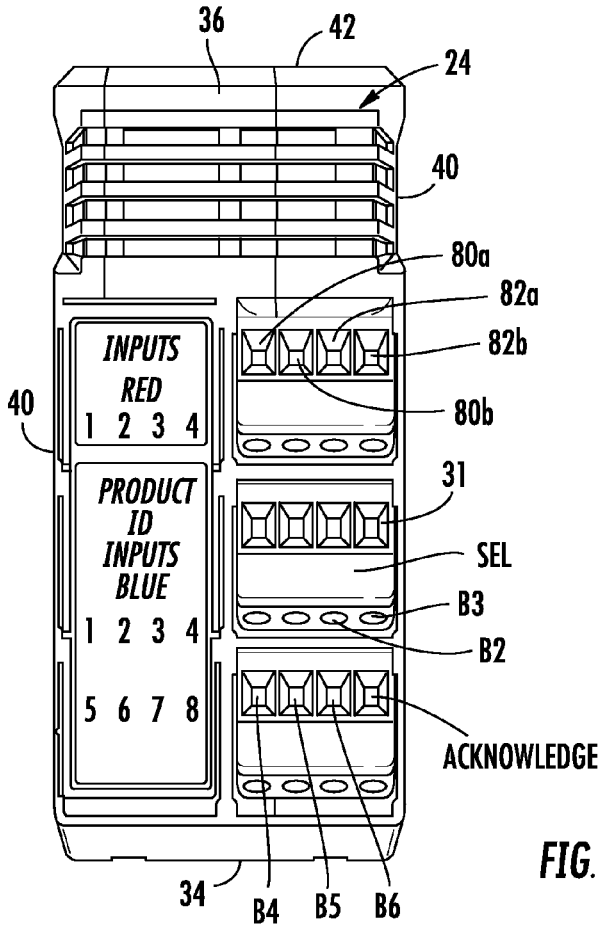
FIG. 5 is a top view of the control unit of FIG. 3.

In the illustrated embodiments, control unit 24 includes eight product ID inputs/outputs positioned on the top 36 of housing 32 (FIG. 5). The product ID inputs are labeled B1-B6 and SEL. The product ID output is labeled ACKNOWLEDGE. Each of the product ID inputs are configured to receive a pin or wire from product ID signal generator 76. Control unit 24 is thus electrically coupled with product ID signal generator 76 by way of eight wires, although it will be understood that different numbers of wires can be used within the scope of the invention. Six of these eight wires will transmit a logic high or a logic low signal which will identify a product. These six wires will be coupled to product ID inputs B1-B6. The other two wires, which will be coupled to product ID inputs/outputs SEL and ACKNOWLEDGE, control the selection and acknowledgement, respectively, of the signals transmitted between product ID signal generator 76 and control unit 24.

As noted, the information transmitted to inputs B1-B6 will be a binary value (low or high). These values will determine the specific product identification. Thus, for example, if control unit 24 detects that product ID input B1 is high, B2 is low, B3 is low, B4 is high, B5 is high, and B6 is low, then it will know that is has received a product identification signal corresponding to binary 100110, which corresponds to decimal 38. Because there six different binary product inputs B1-B6 in the illustrated embodiments, it is possible for control unit 24 to receive $2^6$, or 64, different product identifications. It will be understood, of course, that additional product ID inputs can be added to control unit 24 to allow for a greater number of product identifications, if desired. Alternatively, it would also be possible to transmit the product identification data serially over a single line. Still other possibilities for communicating product identification data to control unit 24 are possible, including, but not limited to, transmission via an Ethernet or other network.

The SEL product ID input tells control unit 24 when to read the B1-B6 inputs. That is, when control unit 24 detects a logic high signal at the SEL input, it reads the then current values of inputs B1-B6 and uses those to determine the product identification. If the values of inputs B1-B6 fluctuate, or otherwise change, after the control unit 24 has read them in response to the SEL input receiving the logic high signal, control unit 24 will ignore those fluctuations until it receives another high signal at the SEL input. After control unit 24 reads the values at inputs B1-B6, it will output a logic high signal at the ACKNOWLEDGE output. This allows the product ID signal generator to know that control unit 24 has read the signals on lines B1-B6. The SEL and ACKNOWLEDGE contacts thus give the product ID signal generator the freedom to not have to maintain a product ID signal constantly at inputs B1-B6.

After control unit 24 receives a product select input at inputs B1-B6, control unit 24 retrieves from its memory the data parameters that are associated with the particular product. These may includes the strobe characteristics and/or the current level settings for the LEDs 27. Control unit 24 then implements these parameters in its control of the LED drivers 26 that are electrically coupled thereto. Because control unit 24 can implement the changes to the control parameters within a few milliseconds, or faster, after receiving a new product ID signal from inputs B1-B6, it is possible to change the product IDs extremely rapidly. This gives the control unit the ability to control the LED lights in different manners even in high speed situations where the associated cameras may be taking 5000 or more pictures a minute and the products being photographed may be changing at an equally high rate. Control unit 24 thereby allows a user to tailor the lighting supplied by the LEDs 27 to multiple different products and to change those individually tailored lighting configurations on the fly and at very high rates of speed.

For testing purposes, the product identification number can be communicated to control unit 24 via software, rather than the hard-wired connections of B1-B6. This is accomplished through the "Override Product ID" data field 66 shown in FIG. 8. The user simply types in the desired product ID into the "Override Product ID" data field 66 and presses the adjacent "set" button next to it. This causes control unit 24 to use the control parameters corresponding to the product ID that was just entered into the "Override Product ID" data field 66, rather than any product ID signals that may be currently being transmitted along hard-wire inputs B1-B6.

As illustrated in FIG. 5, top 36 of housing 32 of control unit 24 also includes a pair of power inputs 80*a* and *b*. Power input 80*a* is connected to a DC source of voltage, such as 24 volts, although the illustrated embodiments allow up to 28 volts DC to be supplied into input 80*a*. It will be understood, of course, that the invention can be practiced using different supply voltages. Power input 80*b* is a ground input. Another pair of inputs 82*a* and *b* are positioned on top 36 of control unit 24. Inputs 82*a-b* receive the trigger signal from trigger 22. Input 82*a* is used if the trigger 22 is an NPN type of trigger, while input 82*b* is used if trigger 22 is a PNP type of trigger. In an NPN type of trigger, the triggering signal is the transition from a high signal to a low signal. In a PNP type of trigger, the triggering signal is the transition from a low signal to a high signal. Depending upon what type of triggering signal trigger 22 outputs, the appropriate input 82*a* or 82*b* is used to electrically couple control unit 24 with trigger 22.

Figures 6, 7:
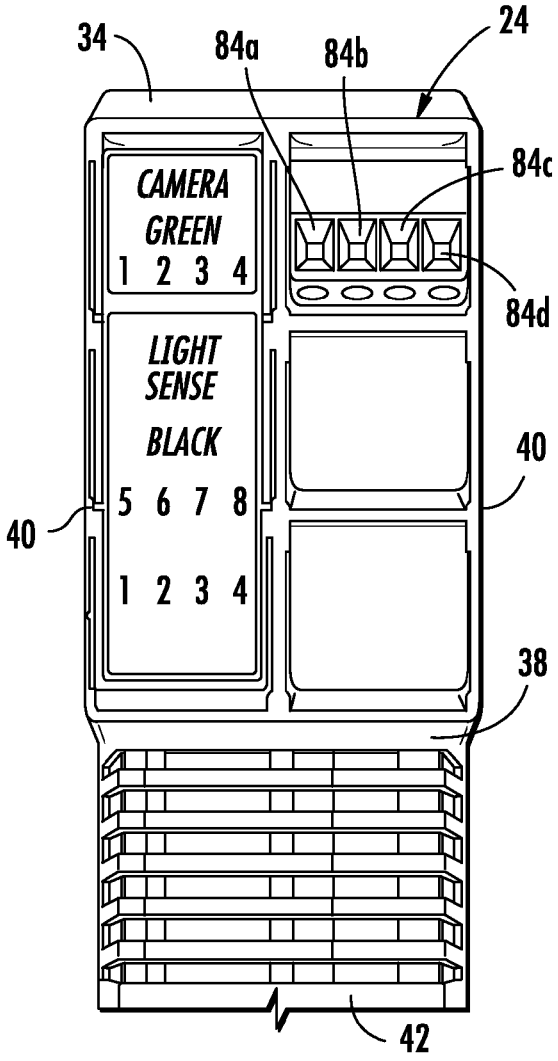
FIG. 6 is a bottom view of the control unit of FIG. 3.
FIG. 7 is a chart illustrating a pin selection that may be used for controlling one or more cameras with the control unit of FIG. 3.

Bottom 38 of control unit 24 includes four camera outputs 84*a-d* that are used to control up to two different cameras 28 (FIG. 7). A wire is inserted into selected one (or ones) of camera outputs 84*a-d* according to the type of triggering signal the camera is intended to receive. As was mentioned above, triggering signals may be of an NPN or PNP types. The type of signal that is to be used for a given camera depends upon the type of interface transistor the camera uses (NPN or PNP). In an NPN type of camera, the camera is triggered when the trigger input for the camera goes low. In a PNP type of camera, the camera is triggered when the trigger input for the camera goes high. Depending upon how many cameras and which type they are (NPN or PNP), a user connects his or her camera(s) to camera outputs 84*a-d* according to the chart illustrated in FIG. 7. A single PNP camera will be connected to control unit 24 via pin 1 (output 84*a*). A single NPN camera will connect via pin 2 (output 84*b*). An additional PNP or NPN camera would connect via pins 3 or 4 (84*c* or *d*), respectively. The trigger signal that is output on camera outputs 84*a-d* is the signal that is controllable in the third data field group 60 of screen shot 52. That is, the delays entered into data fields 60 will cause control unit 24 to delay for the specified amount of time before outputting a signal on camera outputs 84*a-d*.

Figure 12:
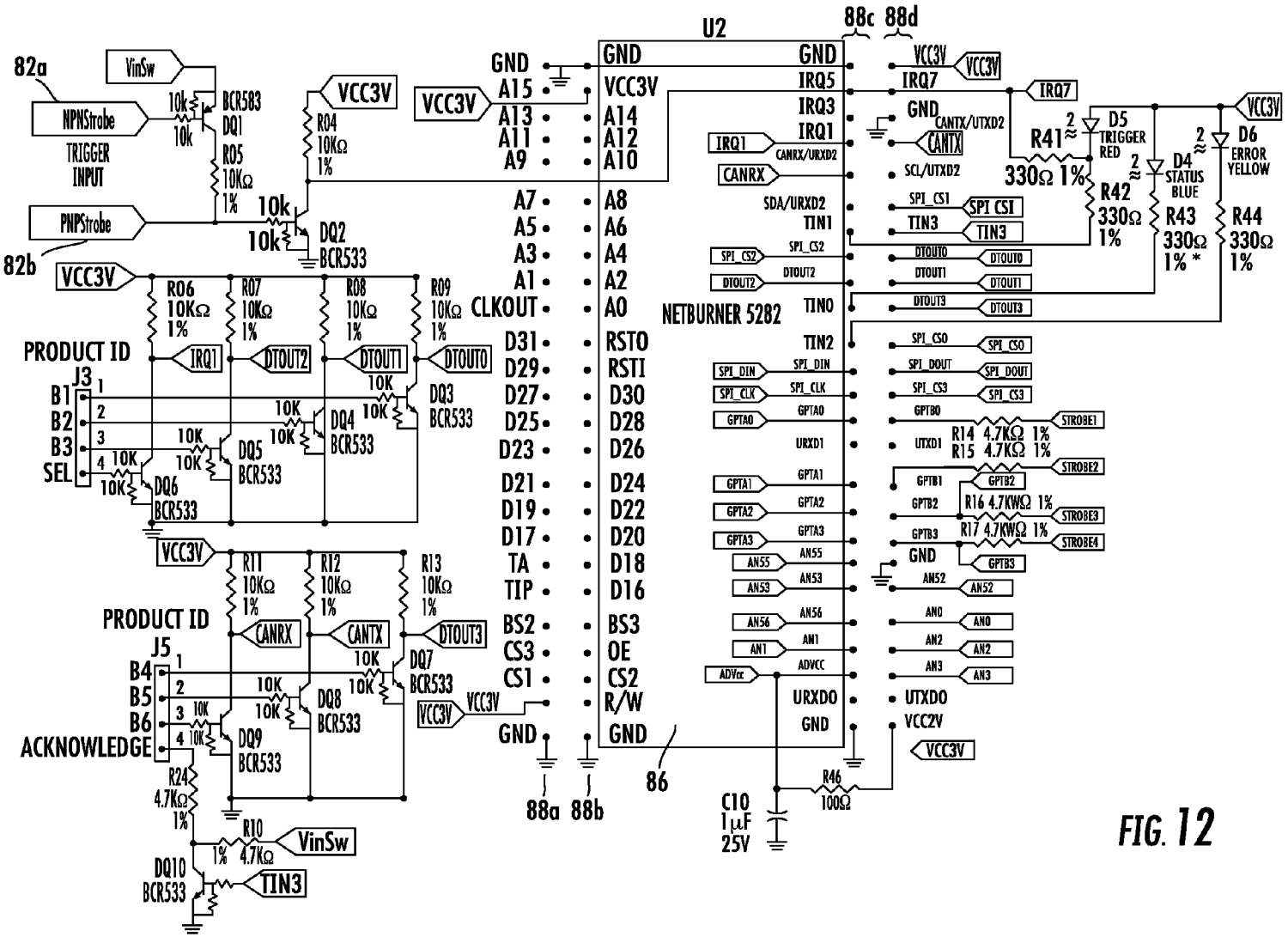
FIG. 12 is a partial electrical schematic of the circuitry of the control unit of FIG. 3 (other portions of the electrical schematic are illustrated in FIGS. 13-16.

An electrical schematic of one embodiment of control unit 24 is depicted collectively in FIGS. 12-16. It will be understood by those skilled in the art that the precise manner of implementing the features of control unit 24 that are described herein can be accomplished in a wide variety of different manners and designs from those depicted in FIGS. 12-16. While FIGS. 12-16 are each separate figures, they all are part of a single schematic. The interconnections between the various circuits depicted in the various figures are identified by using a flag type of notation wherein an item identified in a flag in any of FIGS. 12-16 is electrically coupled to all other like-identified items in the flags of FIGS. 12-16 despite the fact that an electrical wire is not explicitly shown in the drawings. Thus, for example, the $V_{insw}$ identifier in a flag appearing in the upper left hand corner of FIG. 12 is electrically coupled to the flag in the lower left corner of FIG. 12 that includes the $V_{insw}$ identifier, as well as the flags bearing the $V_{insw}$ identifier in FIG. 13 (upper right corner), FIG. 14 (three times in the center), FIG. 15 (upper left corner), and FIG. 16 (upper left corner). The $V_{insw}$ refers to a supply voltage that is received from a power supply circuit 94 illustrated in FIG. 16, and described in more detail below.

Turning to FIG. 12, control unit 24 includes a microcontroller 86 which, in the embodiment depicted therein, is a model MOD5282-100CR sold by Netburner, Inc. of San Diego, Calif. The operation of the MOD5282 is described in more detail in a MOD5282 datasheet published by Netburner, Inc., which is incorporated herein by reference. Suffice it to say that microcontroller 86 is programmed to carry out the functions described herein in a manner that would be known to one skilled in the art. Microcontroller 86 is an integrated circuit mounted on a single electronic substrate that includes two sets of pins 88*a-d* on each side of it. Each set of pins 88 includes twenty-five individual pins, for a total of one hundred pins. The operation of each pin is described in the MOD5282 datasheet and the accompanying product literature published by Netburner, Inc., which is also incorporated herein by reference.

Microcontroller 86 is coupled to three status LEDs D4, D5, and D6 that provide visual indications of the status of microcontroller 86. Status LEDs D4, D5, and D6 are not the high intensity LEDs 27 driven by LED drivers 26 that are used to provide illumination for photography. Instead, LED D4 will output a flashing blue light at a first frequency if control unit 24 has not been configured, and will output a flashing blue light at a different frequency after control unit 24 has been configured. Red LED D5 will flash every time a trigger signal is received by control unit 24 from trigger 22. Yellow LED D6 will output a yellow light if control unit 24 detects an error, such as a trigger signal being received from trigger 22 too soon before control unit 24 could finish executing its response to the prior trigger signal.

Turning to the upper left corner of FIG. 12, the flagged references to the "NPNStrobe" and "PNPStrobe" refer to the trigger inputs 82*a* and *b*, respectively, of control unit 24. The NPNStrobe input (82*a*) is fed through an NPN transistor DQ1, which is a transistor having built in bias resistors. The output of transistor DQ1, as well as PNPStrobe (input 82*b*) is fed through a second transistor DQ2 (having built in bias resistors) before passing onto an interrupt IRQ5 and IRQ7 on microcontroller 86. Microcontroller 86 is programmed to respond in accordance with the functions described herein upon receiving a signal at its IRQ7 pin. IRQ7 is disabled after receiving the trigger until the Prod ID parameters have completed. IRQ5 monitors for triggers received during this time and may flag an error LED if triggers are received.

The product identification inputs B1-B6 are shown on the left side of FIG. 12 and are distributed across two connectors J3 and J5. The SEL product ID signal is also fed into connector J3, and the product ID ACKNOWLEDGE signal feeds out of connector J5. Input B1 is fed though a transistor DQ3 having built-in bias transistors before being fed to DTOUT0, which is one of the pins in the third set 88*c* of pins on microcontroller 86. Similarly, inputs B2-B6 are fed into transistors DQ4-DQ5, and DQ7-DQ9, respectively, before being passed onto the DTOUT1, DTOUT2, DTOUT3, CANTX, and CANRX pins on microcontroller 86. Microcontroller uses the inputs from the product ID signals B1-B6, SEL, and ACKNOWLEDGE, as well as the trigger inputs 82*a* and *b* to output controls to the LED drivers 26 to carry out the functions described above.

Figure 13:
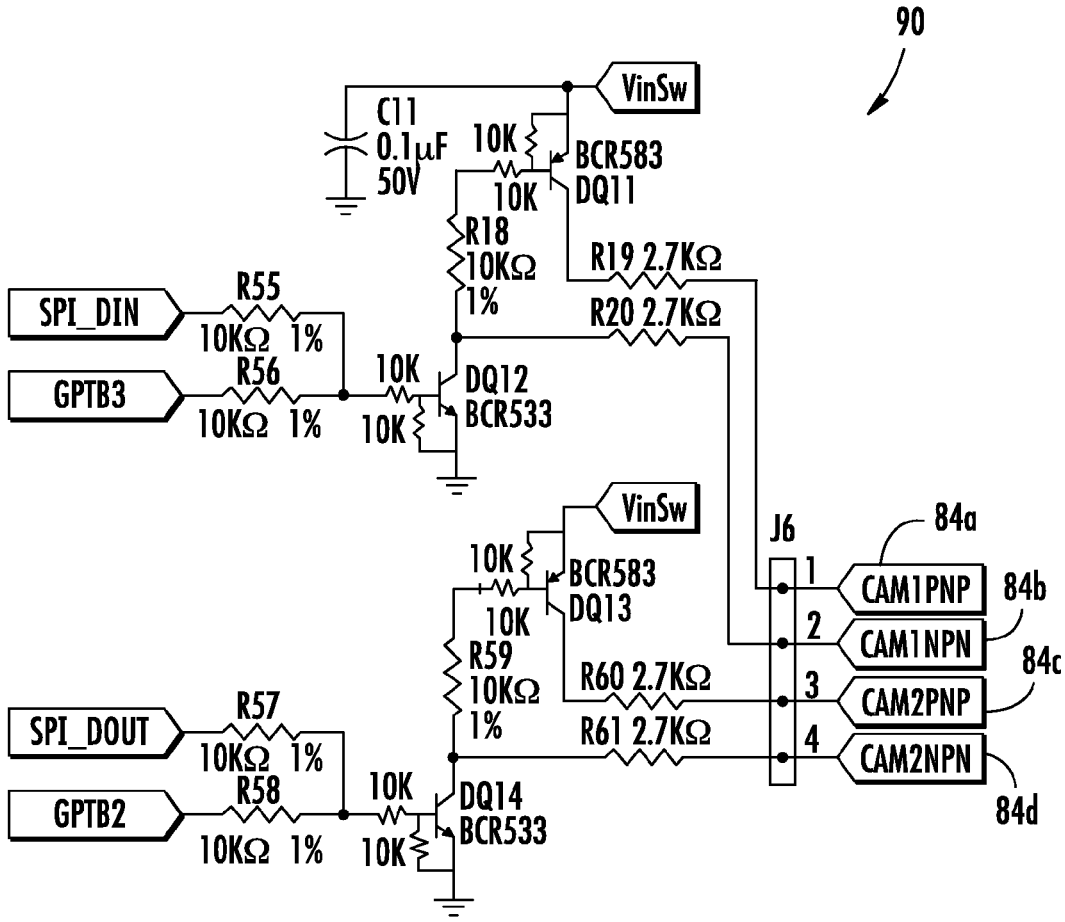
FIG. 13 is an electrical schematic of a camera control circuit for the control unit of FIG. 3 wherein the camera control circuit is electrically coupled to the circuit of FIG. 12.

A camera control circuit 90 is illustrated in FIG. 13. Camera control circuit 90 is electrically coupled to four pins of microcontroller 86: SPI_DIN, GPTB3, SPI_DOUT, and GPTB2 (see FIG. 12 as well). These four outputs of microcontroller 86 are fed through an arrangement of transistors DQ11-14 before being passed to connector J6. Connector J6 has four outputs CAM1PNP, CAM1NPN, CAM2PNP, and CAM2NPN. These four outputs of connector J6 correspond to camera outputs 84*a-d*, respectively, which were previously described above and which are illustrated in FIG. 6. Pins GPTB2 and GPTB3 may optionally be used to adjust the timing of the camera strobe outputs, but are not necessarily always used in all embodiments.

Figure 14:
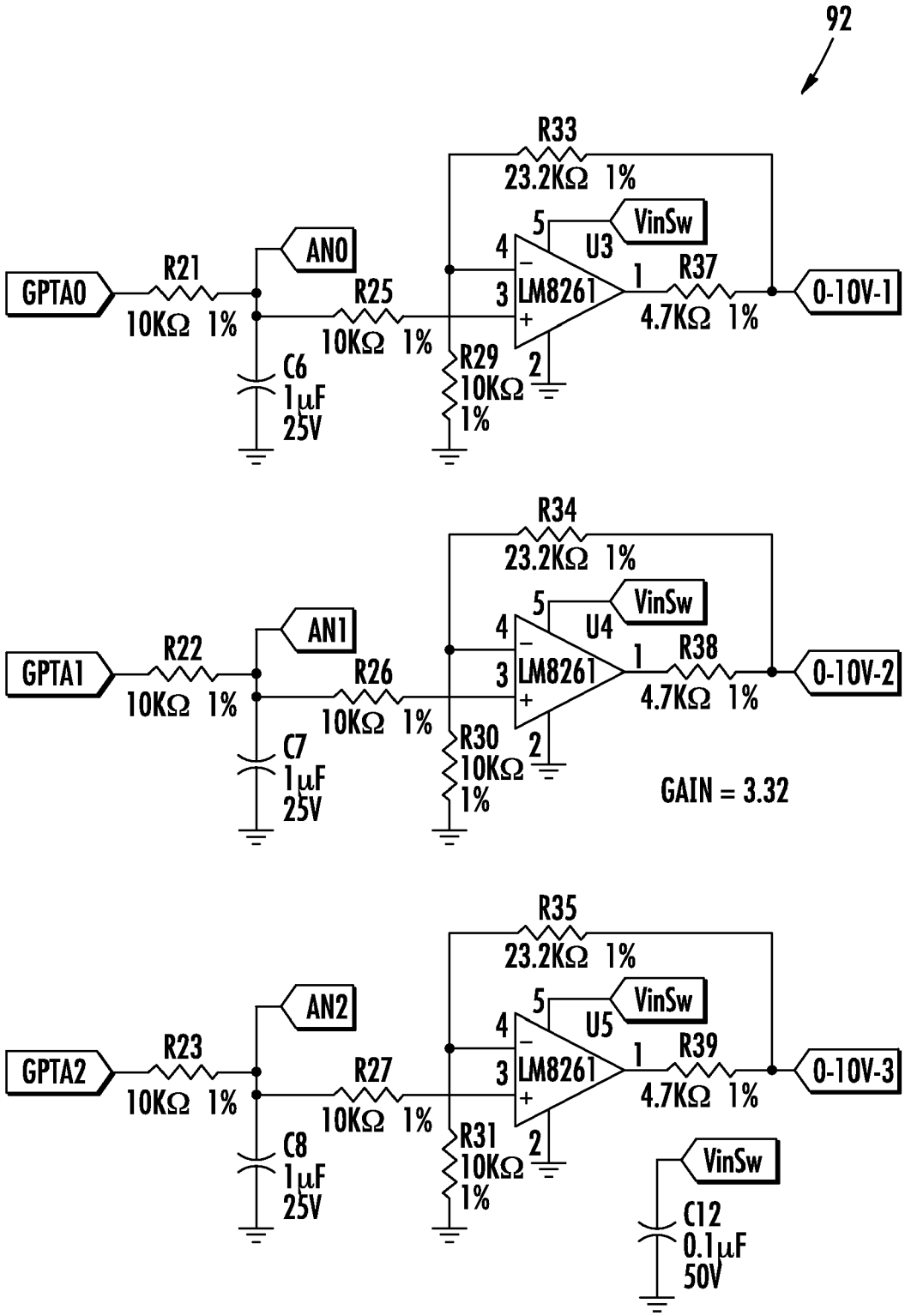
FIG. 14 is an electrical schematic of an amplifier circuit for the control unit of FIG. 3 wherein the amplifier circuit is electrically coupled to the circuit of FIG. 12.

An amplifier circuit 92 is illustrated in FIG. 14. Amplifier circuit 92 functions to output up to three different voltages to the LED drivers 26. These voltages instruct the LED drivers to illuminate their electrically coupled LEDs 27 with a specific amount of current. The voltages are output on electrical lines 48*b-d*, which form part of bus 30, to which the LED drivers 26 are operatively coupled. As was discussed previously, control unit 24 can be configured to control the intensity of the light emitted from the LEDs 27 by selecting a percentage value in the data fields 58*a-c* of screen shot 52. If, for example, the first data field 58*a* has a value of 50% entered into it by the user, then control unit 24 will output a control signal on electrical line 48*d* that instructs all the LED drivers 26 electrically coupled thereto to illuminate their LEDs 27 using a current of 50% of the continuous maximum rated current for the LEDs 27 coupled thereto. Alternatively, the current may be set such that the light emitted by the LED's 27 is equal to 50% of the maximum sustained light output of the LEDs, which may result from a current different than 50% of the maximum continuous current.

In the illustrated embodiment, the specific control signal output by control unit 24 onto electrical line 48*d* will be a voltage from between zero to ten volts. The precise voltage will be the percentage of ten volts that was specified in the first data field 58*a*. In other words, if the user specifies 10% in data field 58*a*, then control unit 24 will output a voltage of one volt on electrical line 48*d*. If the user specifies 50%, then five volts will be output. If the user specifies 100%, then ten volts will be output.

Control unit 24 operates in a similar manner with respect to data fields 58*b* and 58*c*. Whatever percentage a user enters into data field 58*b* will cause control unit 24 to output that percentage multiplied by ten volts onto electrical line 48*c*. Whatever percentage a user enters into data field 58*c* will cause control unit 24 to output that percentage multiplied by ten volts onto electrical line 48*b*.

Control unit 24 outputs the specified voltage onto electrical line 48*d* by way of pins GPTA0 and AN0 of microcontroller 86. The signals from these two pins are fed into an operational amplifier U3, such as an LM8261 manufactured by National Semiconductor of Santa Clara, Calif., which causes an amplified voltage to be produced at the point labeled "0-10V-1" (FIG. 14) that corresponds to the percentage specified in data field 58*a* multiplied by ten volts. Similarly, control unit 24 outputs the specified voltage onto electrical line 48*c* by way of pins GPTA1 and AN1 of microcontroller 86, which are fed into another operational amplifier U4 that causes an amplified voltage to be produced at the point labeled"0-10V-2" (FIG. 14), which corresponds to the percentage specified in data field 58*b* multiplied by ten volts. Also, control unit 24 outputs the specified voltage onto electrical line 48*b* by way of pins GPTA2 and AN2 of microcontroller 86, which are fed into another operational amplifier U5 that causes an amplified voltage to be produced at the point labeled "0-10V-3" (FIG. 14), which corresponds to the percentage specified in data field 58*c* multiplied by ten volts.

A bus configuration circuit 96 is illustrated in 15. Bus configuration circuit 96 controls what signals will be output onto bus 30. As discussed above, bus 30 includes five electrical lines 48*a-e*. These five lines are coupled to connector J7 in FIG. 15 wherein port 5 connects to line 48*a*, port 4 to line 48*b*, port 3 to line 48*e*, port 2 to line 48*d*, and port 1 to line 48*c*. Control unit 24 determines what signals will be transmitted on the various lines 48 of bus 30 by way of a quad, single pole double throw electronic switch U6, which, in the illustrated embodiment, is a model ADG333A+/−15V Quad SPDT Switch sold by Analog Devices of Norwood, Mass., although other types of switches may be used. For electrical lines 48*b-d*, control unit 24 has the option of outputting an intensity control signal or a strobing control signal, as was discussed previously. The choice of which type of control signal to output is determined by the user. If the user enters strobe control parameters into data field group 56*b* corresponding to "Strobe Channel 2" (see FIG. 8), then control unit 24 will transmit a signal from pin SPI_CS1 that causes a switch D2 within quad switch U6 (FIG. 15) to connect the "Strobe 2" signal to electrical line 48*b*.

In a similar manner, if a user enters strobe control parameters into data field group 56*c* corresponding to "Strobe Channel 3" (FIG. 8), the control unit 24 will transmit a signal from pin SPI_CS3 that causes a switch D4 within quad switch U6 (FIG. 15) to connect the "Strobe 3" signal to electrical line 48*c*. Likewise, if a user enters strobe control parameters into data field group 56*d* corresponding to "Strobe Channel 4" (FIG. 8), the control unit 24 will transmit a signal from pin SPI_CS2 that causes a switch D3 within quad switch U6 (FIG. 15) to connect the "Strobe 4" signal to electrical line 48*d*. The status of SPI_CS1, 2, and 3 are determined by the bus output configuration data field 68 (FIG. 8).

Alternatively, if a user enters a current control value into data field 58*a* (and thus has no strobe control data in the data field 56*d* for "Strobe Channel 4"), then control unit 24 will transmit a signal from pin SPI_CS2 that causes switch D3 within quad switch U6 (FIG. 15) to connect the 0-10V-1 signal to electrical line 48*d*. If a user enters a current control value into data field 58*b* (and thus has no strobe control data in the data field 56*c* for "Strobe Channel 3"), then control unit 24 will transmit a signal from pin SPI_CS3 that causes switch D4 within quad switch U6 (FIG. 15 to connect the 0-10V-2 signal to electrical line 48*c*. And if a user enters a current control value into data field 58*c* (and thus has no strobe control data in the data field 56*b* for "Strobe Channel 3"), then control unit 24 will transmit a signal from pin SPI_CS1 that causes switch D2 within quad switch U6 (FIG. 15 to connect the 0-10V-3 signal to electrical line 48*b*.

Figure 16:
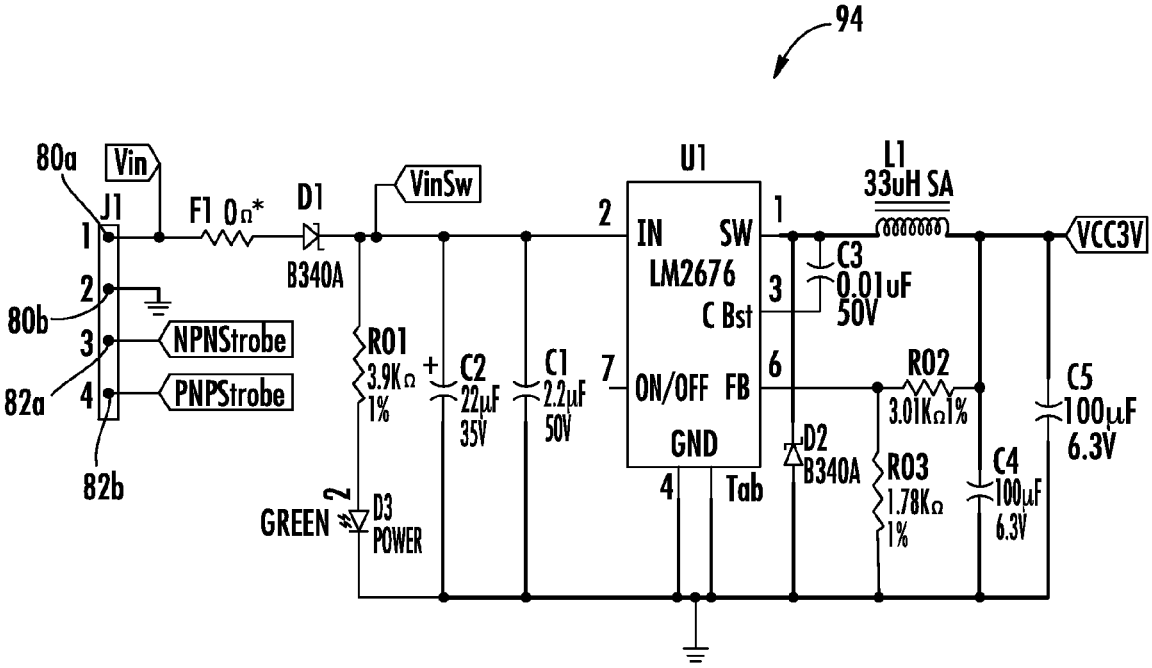
FIG. 16 is an electrical schematic of a power supply circuit for the control unit of FIG. 3 wherein the power supply circuit is electrically coupled to the circuit of FIG. 12.

FIG. 16 illustrates the power supply circuit 94 which supplies approximately 3.3 volt DC power (VCC3V) to microcontroller 86 and various other components of control unit 24. Power supply circuit receives its power from pin 1 of connector J4, which corresponds to power input 80*a* (discussed previously) and which may be coupled to an external power supply, such as a 24 volt DC power supply. Pin 2 of connector J4 corresponds to ground power input 80*b*, as discussed previously. The green diode D3 in power supply circuit 94 is a status LED that provides a visual indication that power is being received by control unit 24. This green diode D3 is not one of the high intensity LEDs 27 controlled by LED drivers 26 that are used for providing photography illumination.

The types of LED drivers 26 which control unit 24 can control are variable. Three examples of such LED drivers 26*a, b*, and *c* are discussed in more detail below, although it will be understood by those skilled in the art that additional types of drivers can be controlled by control unit 24, and that substantial variations of the LED drivers 26 discussed in detail below can be made without departing from the scope of the invention. Before discussing the detailed schematics of the LED drivers 26*a, b*, and *c* it may be helpful to discuss the manner in which information is communicated to the LED drivers 26 along bus 30.

Figure 11:
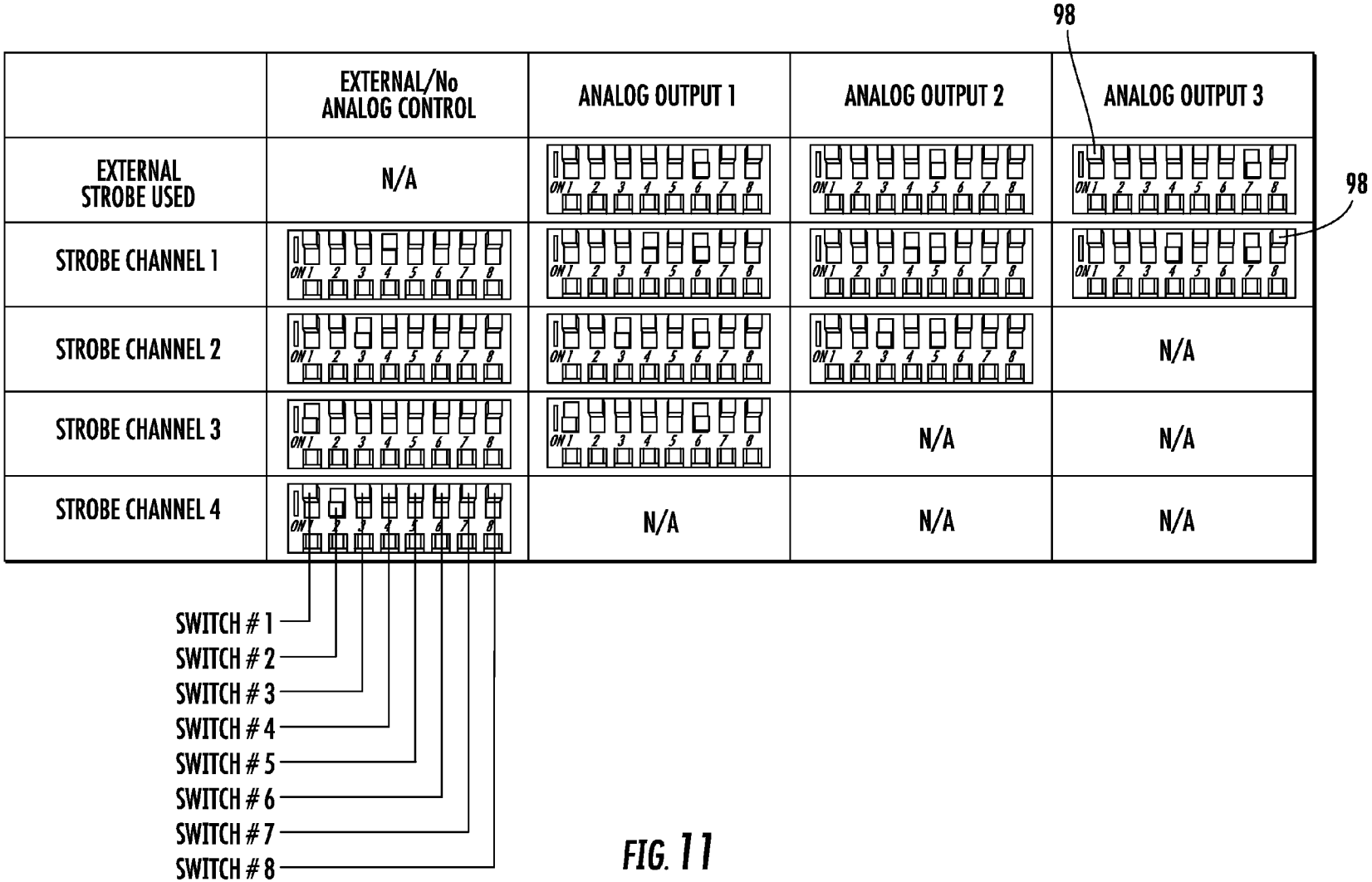
FIG. 11 is a chart illustrating different switch configurations to be implemented on the one or more LED drivers in order to implement control of the LED flashes and the intensity of the light of the LED flashes.

Each of the LED drivers 26, if configured to communicate with control unit 24, will include a plurality of dip switches 98, such as those illustrated in FIG. 11. As shown in FIG. 11, there are eight dip switches on the driver 26, and they are labeled consecutively 1-8 from left to right. The dip switches are manually set by the user so that the respective driver 26 will respond to the desired ones of electrical lines 48*a-e*. The manner in which the dip switches are set to achieve the different control configurations are illustrated in the chart of FIG. 11. The left column identifies the four strobe channels, any one of which the LED driver may respond to. The top row identifies the "analog outputs", which refer to the control signals for controlling the intensity of the LEDs 27 driven by the driver 26. Each LED driver 26 has the option of having its strobing controlled by control unit 24, the intensity of its lights controlled by control unit 24, or both its strobing and intensity controlled by control unit 24.

By appropriately setting the dip switches 98 on each driver 26, the driver will respond to the desired strobing or intensity (analog) control signals. Thus, turning to the chart of FIG. 11, if a particular LED driver is to have its strobing controlled by channel 2, for example, and its intensity controlled by analog output 1 (electrical line 48*d*), the third and fifth dip switches 98 on the driver should be flipped downward. On the other hand, if a particular LED driver is to have its strobing controlled by channel 1 and no intensity control, the fourth dip switch 98 would be flipped downward. The chart of FIG. 11 illustrates the various other configurations of the dip switches for connecting the LED drivers to the electrical lines 48 of bus 30 in the appropriate manners.

Figure 10:
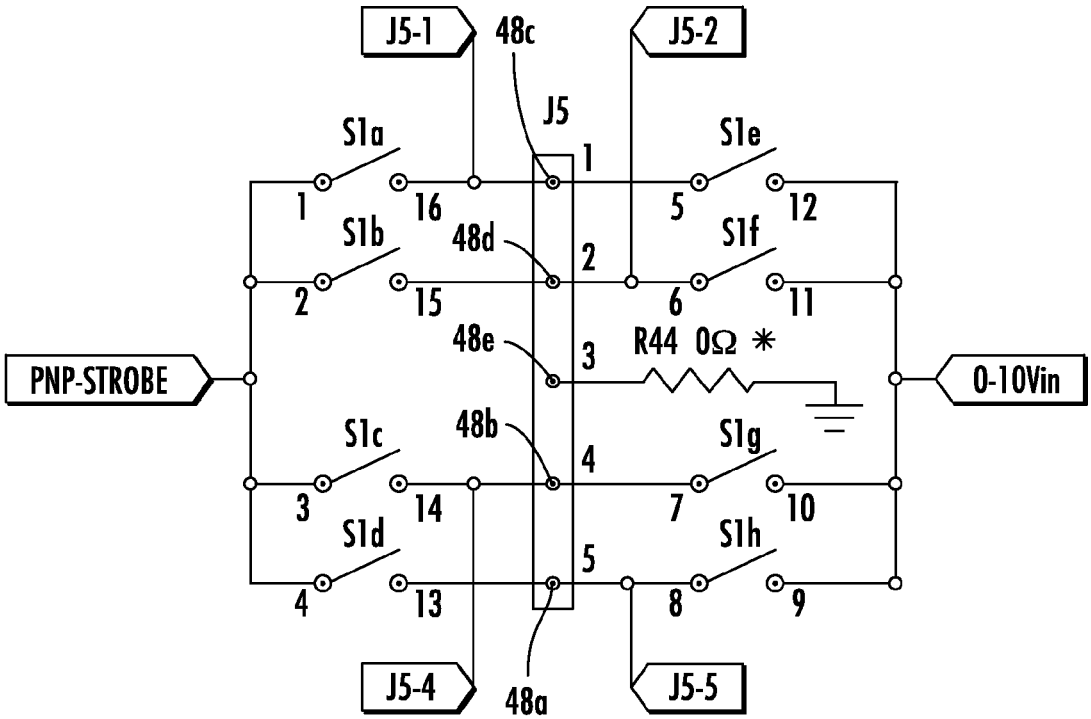
FIG. 10 is an electrical schematic of a connector and associated switches used by an LED driver to connect to a bus.

FIG. 10 illustrates a connector J5 that may be used on any one of the LED drivers 26 discussed herein, including drivers 26*a, b*, or *c* (discussed in greater detail below). This connector J5 is electrically coupled to the five wires 48*a-e* bus 30, which are in turn connected to the J7 connector of control unit 24 (shown in FIG. 15). The switches illustrated in FIG. 10 correspond to the dip switches 98 discussed above and illustrated in FIG. 11, wherein switch S1*a*=dipswitch 1, S1*b*=dipswitch 2, S1*c*=dipswitch 3, S1*d*=dipswitch 4, S1*e*=dipswitch 6, S1*f*=dipswitch 5, and S1*g*=dipswitch 7. (Switch 8 (S1*h*) is not used in the illustrated embodiment). As can be seen in FIG. 10, flipping the dip switches 98 will cause the appropriate electrical lines of connector J5 to be output to different points, one labeled PNP-strobe and the other labeled 0-10Vin. These two points are electrically coupled to the internal circuitry of the LED driver, as will be discussed in more detail below.

As should be apparent from the foregoing discussion, control unit 24 can control a plurality of different LED drivers according to different control parameters via bus 30. While bus 30 only includes four electrical lines 48*a-d* for transmitting control signals (48*e* is a ground), this does not mean that control unit 24 can only control four LED drivers 26. Rather, control unit 24 can control dozens of LED drivers 26. The fact that there are only four electrical lines 48*a-d* available for sending control signals simply means that the different ways in which the LED drivers 26 can be controlled from one another is limited by the number of different valid combinations of the intensity and strobing control signals the LED driver 26 can tap into on bus 30. Thus, as one example, it may be possible for control unit 24 to be controlling the strobing of five LED drivers 26 in the same manner via strobe channel 1 (with no intensity control), two LED drivers in another manner via strobing channel 2 (also with no intensity control), another three LED drivers in yet another manner according to strobing channel 3 (with no intensity control), another LED driver that follows the strobing signals of strobe channel 2 and the intensity control of analog output 1 (electrical line 48*d*), another pair of LED drivers that follow the strobing signals of strobe channel 1 and the intensity control of analog output 1 (electrical line 48*d*), and still more LED drivers that follow the strobing signals of strobe channel 3 and the intensity control of analog output 1. Numerous other combinations are also possible, but, as can be seen, control unit 24 is by no means limited to controlling only four LED drivers 26.

Figure 17:
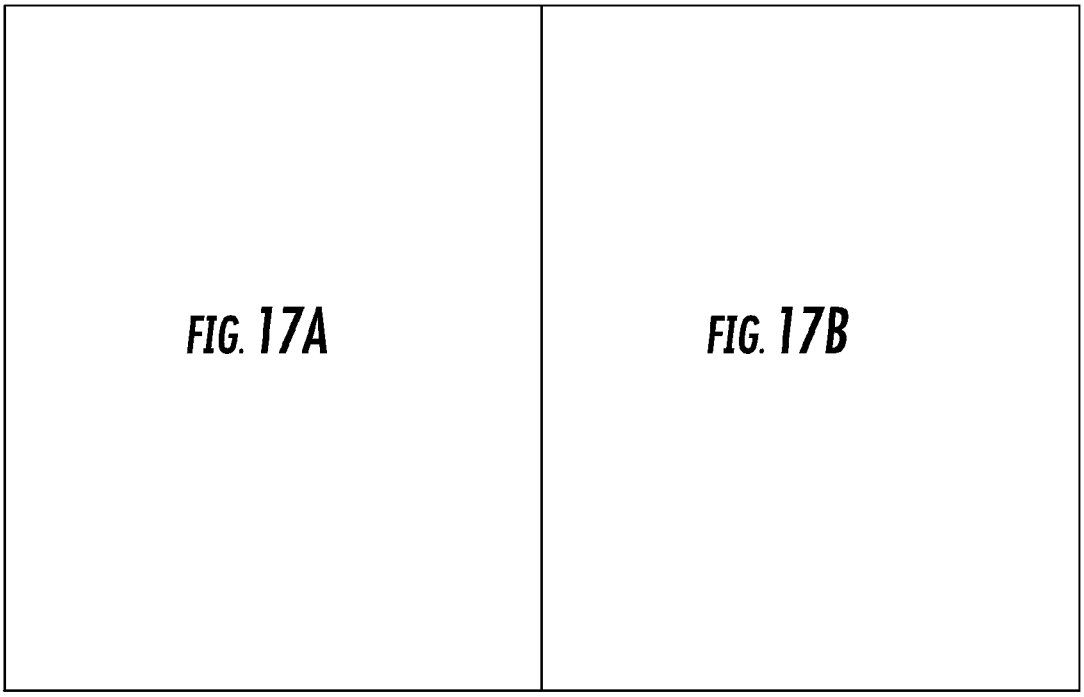
FIG. 17 is a diagram illustrating the orientation in which FIGS. 17A and 17B should be viewed so as to be properly combined into the single electrical schematic shown between the two figures.
Figure 17A:
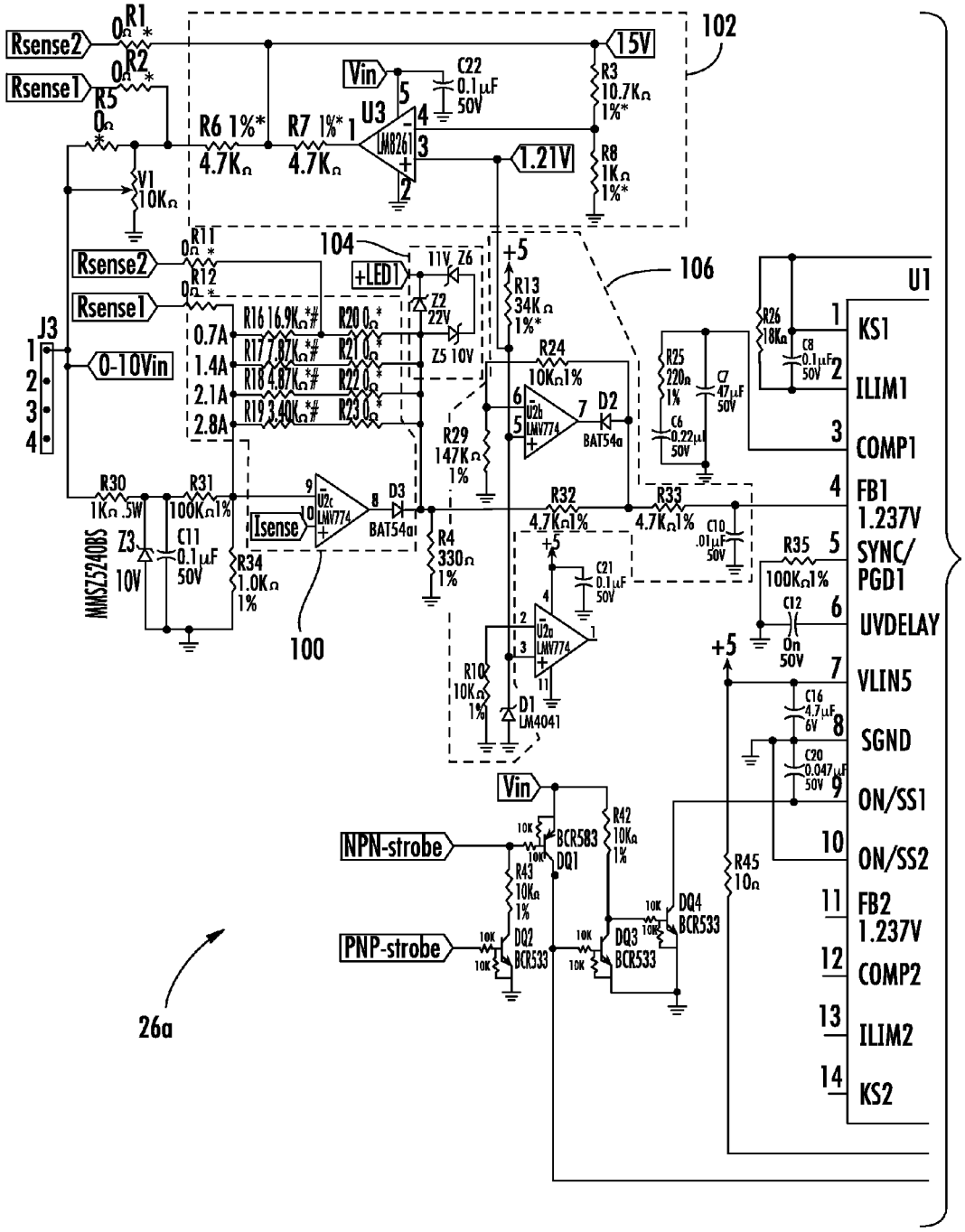
FIG. 17A is a first portion of an electrical schematic of an LED driver according to one aspect of the present invention that may be used alone or in combination with the LED driver controllers of FIG. 1 or 2.
Figure 17B:
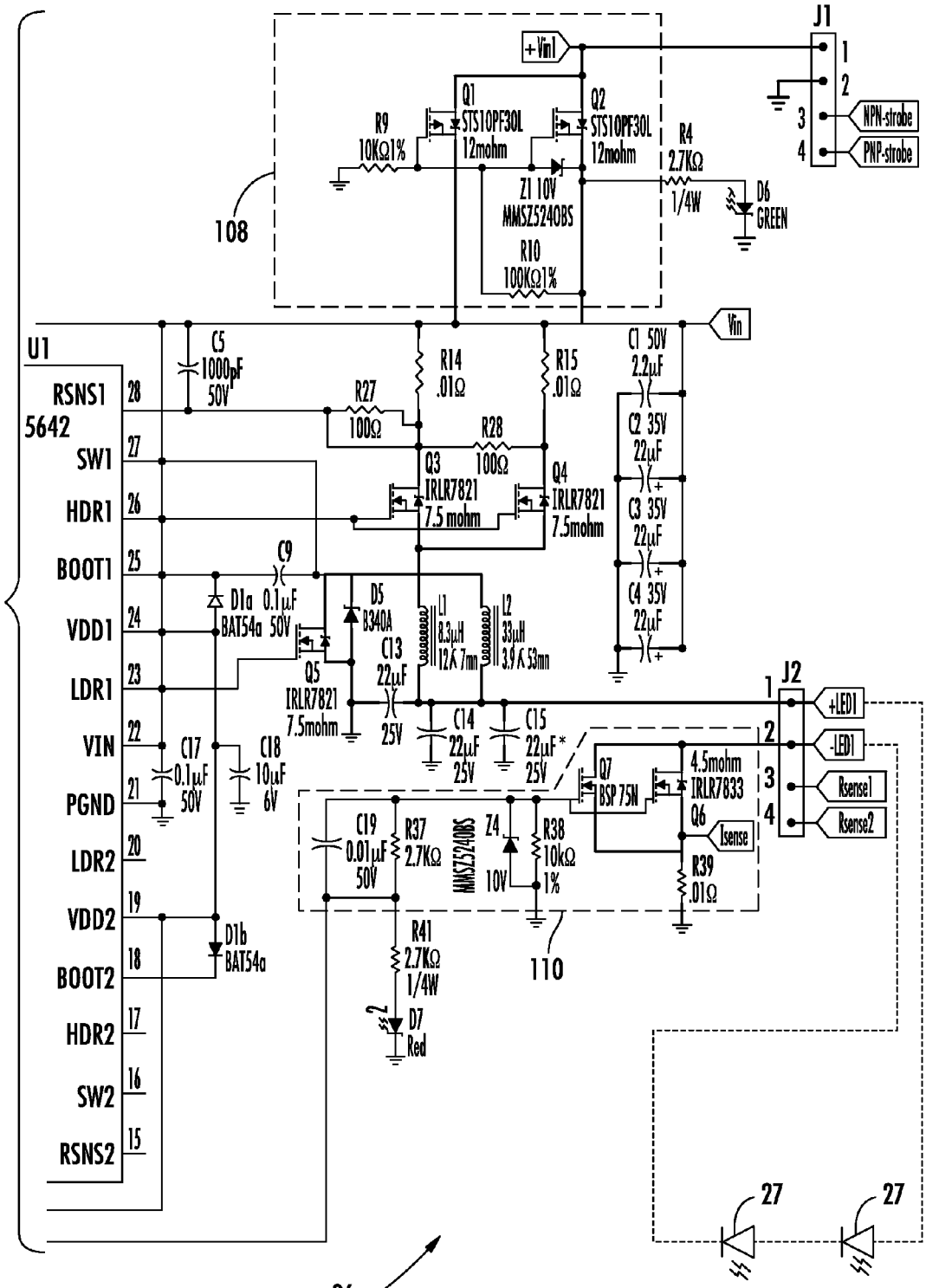
FIG. 17B is a second portion of the electrical schematic of FIG. 17A.

An electrical schematic of one LED driver 26*a* in accordance with the present invention is depicted in FIGS. 17A and 17B, which should be viewed together as a combination oriented in the manner illustrated in FIG. 17. Driver 26*a* of FIGS. 17A and 17B may be used in conjunction with control unit 24, or it may be used without control unit 24. When used without a control unit, an external trigger signal is fed into either the NPN-Strobe or PNP-Strobe inputs shown in FIG. 17A. When used with control unit 24, driver 26*a* receives the strobe signal from bus 30 via one of the electrical lines 48 coupled to connector J5 (FIG. 10). This strobe signal, labeled PNP-Strobe in FIG. 10, is electrically coupled to the like-labeled PNP-Strobe point in the circuit of FIG. 17A. From the point labeled PNP-Strobe, the strobe signal passes through a series of transistors DQ1-4 having built-in bias resistors before being fed into a buck converter U1. Thus, regardless of whether driver 26 is controlled by control unit 24 or some other device, it will be triggered by a signal fed into either its NPN-Strobe or PNP-Strobe inputs. Transistors DQ3 & 4 are optional, and may be omitted in some embodiments.

Buck converter U1 may be an LM5642 integrated circuit manufactured by National Semiconductor of Santa Clara, Calif., although it will be understood that other types of buck converters, as well as other converters, can be used in accordance with this aspect of the present invention. Buck converter U1 is shown split in half, with a left half appearing on FIG. 17A and a right half appearing on FIG. 17B. Buck converter U1 includes 28 pins, the first fourteen of which are illustrated in FIG. 17A and the second fourteen of which are illustrated in FIG. 17B. Buck converter U1 controls the current that is output to pin 1 of a connector J2 of FIG. 17B. More specifically, buck converter U1, in combination with its associated circuitry, sets a constant current at pin 1 of connector J2 (FIG. 17B) when LED driver 26*a* is instructed to turn on its associated LEDs 27 by control unit 24, or some other external control that inputs a strobe signal into driver 26*a*'s NPN-strobe or PNP-strobe inputs (FIG. 17A). The constant current insures that the LEDs 27 that are driven by driver 26*a* will emit light at a substantially constant level of illumination. This constant level of illumination aids the high-speed photography by providing a constant level of light for each photograph, thereby facilitating the computer analysis of the photographs by reducing the need for the computer analyzing the photographs to account for lighting changes between different pictures.

Pin 1 of connector J2 is directly coupled to one or more high intensity LEDs 27. Although two series-connected high-intensity LEDs 27 are shown illustrated in FIG. 17B, LED driver 26*a* (as well as the other LED drivers 26 discussed herein, such as driver 26*b*) are capable of powering more or fewer LEDs 27. Additional LEDs are simply added in series to the two illustrated in FIG. 17B such that electrical current will pass through all of the attached LEDs (in series) and then return to pin 2 of connector J2.

LED driver 26*a* is configured to turn on its coupled LEDs 27 within ten microseconds or less after receiving a strobe signal at either one of the PNP-Strobe or NPN-Strobe inputs (FIG. 17A). This facilitates applications where control of one or more LEDs is desirably obtained in time periods of less than a millisecond.

If LED driver 26*a* of FIGS. 17A and B is configured to receive a control signal from control unit 24 instructing it to illuminate the LEDs 27 at a specific current level, this intensity control signal will be fed to driver 26 via connector J5 (FIG. 10) wherein pin 1 of connector J5 is coupled to electrical line 48*c*, pin 2 to electrical line 48*d*, pin 3 to electrical line 48*e*, pin 4 to electrical line 48*b*, and pin 5 to electrical line 48*a*

(though pin 5 is not used for controlling the intensity of the LEDs 27). Depending on which of switches S1*e*, S1*f*, or S1*g* is closed, the output of the selected electrical line will be coupled to the point labeled 0-10Vin. The point labeled 0-10Vin in FIG. 10 is electrically coupled to the like-labeled point in FIG. 17A.

Alternatively, driver 26*a* allows for the intensity of the light from the LEDs 27 to be manually controlled instead. If manual control of the LEDs 27 is desired, a user simply turns, or otherwise adjusts, a variable resistor or potentiometer V1 (FIG. 17A). Potentiometer V1 is coupled to a precision voltage reference circuit 102 that supplies a precise voltage of ten volts to potentiometer V1. Depending upon the adjustment of potentiometer V1, a voltage of anywhere between zero and ten volts can be generated to feed into resistor R30 (note: resistor R5 is incorporated into the circuit diagram for potential future use, but would be physically cut or otherwise open-circuited when the driver 26 is operated). Precision voltage reference circuit is coupled to potentiometer V1 in such a manner that a substantially linear relationship is created between the voltage fed into resistor R30 and the adjustment of potentiometer V1. In other words, a change in the physical adjustment of potentiometer V1 (such as the number of degrees of rotation, if a rotary potentiometer is used) will cause a corresponding change in the voltage fed to resistor R30 that is substantially directly proportional to the change in the physical adjustment of the potentiometer. This substantially linear relationship allows for easier control over the amount of current being fed to LEDs 27 as the user can set the potentiometer at the, say, fifty percent level and reliably expect the LEDs 27 to be fed a current equal to fifty percent of their maximum forward current rating. By substantially linear, it is meant that relationship between the physical adjustment of potentiometer V1 and the voltage fed to resistor R30 will not vary from a straight line by more than 10%.

In summary, LED driver 26*a* will receive an intensity control signal that is fed into resistor R30, and the intensity control signal will either come from the manual adjustment of potentiometer V1, or from a control signal sent by control unit 24 to connector J5, which then passes the signal to the point labeled 0-10Vin, which feeds into resistor R30. Regardless of its original source, the intensity control signal fed into resistor 30 will then pass through a resistor R31 before being fed into a programmable feedback loop 100. Programmable feedback loop 100 determines the maximum amount of current that can be delivered to the LEDs 27 (the percentage of this maximum amount of current is specified in screen shot 52 of control unit 24, if used, or by the percentage manually set by potentiometer V1, if that option is used). The maximum amount of current that is desirably delivered to LEDs 27 will depend upon what specific types of LEDs are coupled to driver 26*a*.

Driver 26*a* of FIGS. 17A and B is manufactured to allow it to be easily adapted to driving LEDs 27 having different current ratings. Adjusting the maximum current delivered to LEDs 27 is accomplished by changing various resistors in driver 26*a*. The resistor values that are used to accomplish various different current levels are shown in a chart in FIG. 19 where the notation $I_{LED}$ refers to the current delivered to the LEDs. The chart illustrates how the current supplied to LEDs 27 is accomplished for two different configurations of driver 26*a*. In a first configuration of driver 26*a*, the driver 26*a* does not allow for the current it supplies to LEDs 27 to be adjusted by the 0-10 volt signal supplied either from potentiometer V1 or one of the electrical lines 48 coupled to connector J5. In a second configuration, the driver 26*a* does allow for the current it supplies to LEDs 27 to be adjusted by the 0-10 volt signal supplied either from the potentiometer V1 or one of the electrical lines 48 coupled to connector J5.

In the first configuration, setting the current level supplied to LEDs 27 is accomplished by selecting the resistor values in the second and third columns, from the circuit of LED driver 26A. Thus, in the first configuration, if it is desired to have the LEDs receive a current of, say, 1.4 amps, a resistor value of 7.87 Kilo ohms should be used for one of resistors R16-R19 (the other three resistors are left as an open circuit). If a different value of electrical current is desired to be supplied to LEDs 27 in this first configuration, the other resistance values shown in the second and third columns of FIG. 19 can be used. Other combinations and resistor values besides those shown in FIG. 19 may also be used.

Figure 20:
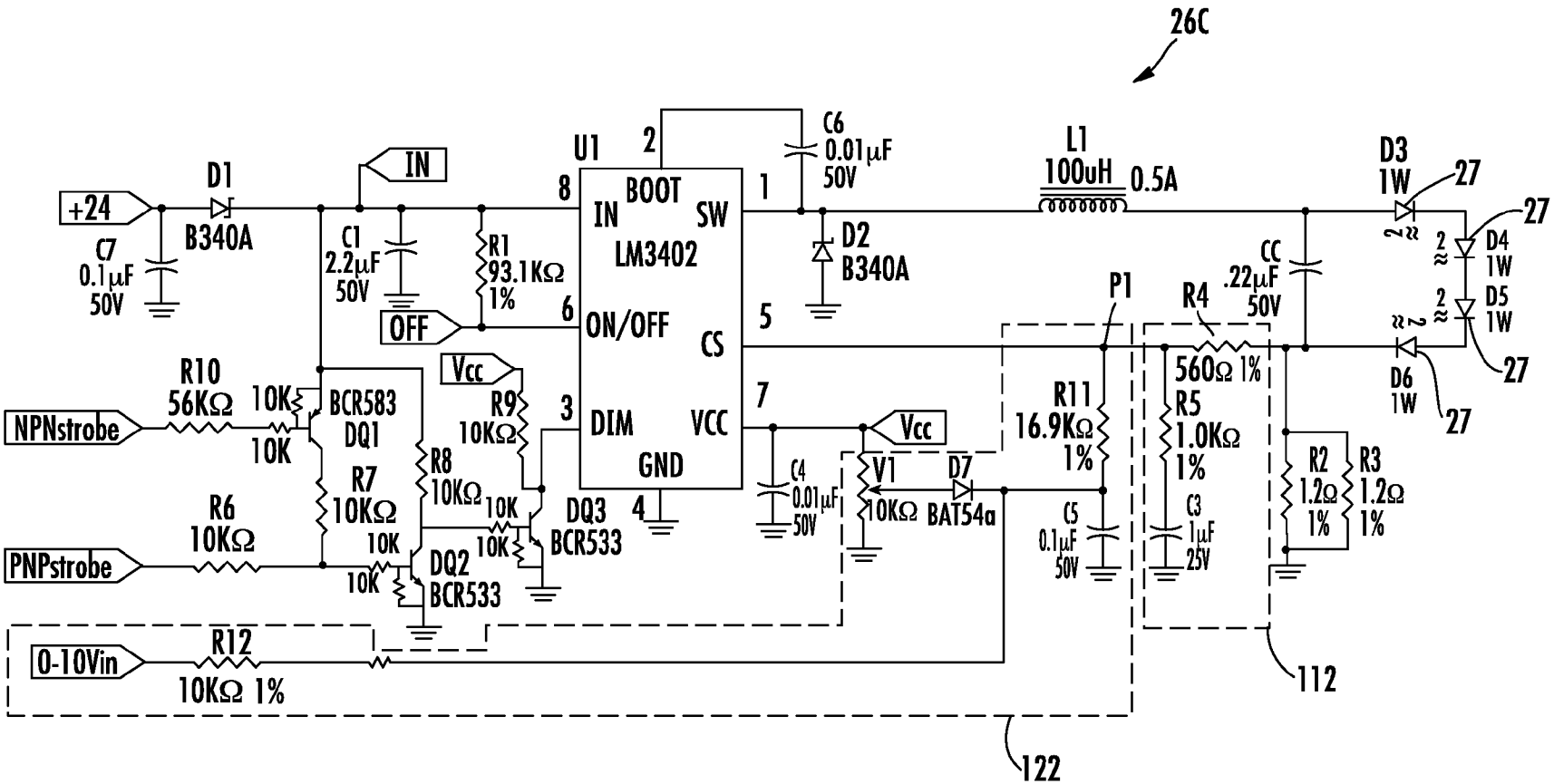
FIG. 20 is an electrical schematic of another LED driver according to another aspect of the present invention that may be used alone or in combination with the LED drivers of FIG. 1 or 2.

In the second configuration of driver 26*a*, where the current to LED's 27 can be dynamically altered according to a 0-10 volt control signal, the maximum current can be varied by altering the resistance values according to the second, fourth, and fifth columns of the chart of FIG. 20. The fourth column of this chart, labeled $R_{fb}$, refers to any one of resistors R16-19 where the other three non-selected resistors of R16-19 are left open-circuited and not used. The simple changing of resistance values according to the chart of FIG. 19 allows for driver 26*a* to be easily configured to driving different types of LEDs 27 that use different amounts of current. Other combinations and resistor values besides those shown in FIG. 19 may also be used.

The output of programmable feedback loop 100 (i.e. the output of diode D3 in FIG. 17A) is fed into a voltage clamp circuit 106 that functions to defeat an overvoltage protection feature built into the LM5642 buck converter integrated circuit. The overvoltage protection feature automatically shuts down the LM5642 buck converter integrated circuit if a voltage is detected at pin FB1 that exceeds the voltage output from the LM5642 by more than a given percentage, such as 14%. Voltage clamp circuit 106 functions to prevent the voltage fed into pin FB1 from ever exceeding this threshold, thereby allowing the LM5642 to be used in the driver 26*a* such that the drivers 26*a* can function in accordance with the description provided herein.

A maximum output voltage circuit 104 is also included in driver 26*a* (FIGS. 17A and B). Maximum output voltage circuit 104 sets the maximum voltage that is output at pin 1 of connector J2 (FIG. 17B), which is the pin that feeds the electrical power to LEDs 27. Maximum output voltage circuit 104 can be adjusted by varying the value of the Zener diode Z2 to match the voltage drop produced by the number of LEDs 27 connected in series to pin 1 of connector J2. Further, maximum output voltage circuit 104 protects capacitors C13, C14, and C15 from being over driven (FIG. 17B). It should be noted that in FIG. 17A, Zener diodes Z5 and Z6 are illustrated as an alternative to using a single Zener diode Z2. Diodes Z5 and Z6 would not actually be implemented in the same circuit with diode Z2, but could be used as a replacement for diode Z2 if a single diode could not be found with the appropriate voltage drop.

Power is supplied to LED driver 26*a* via a connector J1 (FIG. 17B), which includes four ports or pins 1-4. Port 1 is intended to be coupled to the positive terminal of an external source of DC power, which may, for example, be 24 volts. Port 2 is intended to be coupled to the negative terminal of the external source of DC power. Pin 3 couples to any NPN trigger that is being used to trigger LED driver 26. Pin 3 would be used when some external device other than control unit 24 was delivering the strobe signal for controlling driver 26. Pin 4 couples to any PNP trigger that is being used to trigger LED driver 26*a* that comes from a source other than control unit 24

(control unit 24's PNP trigger is fed into connector J5, as discussed above). Pin 4 would only be used when some external device other than control unit 24 was delivering the strobe signal for controlling driver 26.

LED driver 26*a* further includes a low-loss reverse polarity protection circuit 108 (FIG. 17B). Low loss reverse polarity protection circuit 108 protects LED driver 26*a* from being damaged in the case where a user accidentally connects the positive terminal of an external power supply to pin 2 of connector J1 and the negative terminal of the external power supply to pin 1 of connector J1. In other words, circuit 108 protects against someone accidentally connecting the power supply to driver 108 with a reverse polarity. Circuit 108 automatically protects against a mistakenly supplied reverse polarity to pins 1 and 2 of connector J1 so that LED driver 26*a* will not be damaged, even though the external power supply has been incorrectly coupled to LED driver 26*a*. Furthermore, circuit 108 will perform this automatic protection with less power loss than a conventional reverse polarity protection circuit that simply uses a diode to protect against reversed power supply connections. While driver 26*a* will not operate when reverse polarity is applied to it, circuit 108 will ensure it is not damaged by the reverse polarity.

LED driver 26*a* further includes a strobe circuit 110 (FIG. 17B) that performs the switching on and off of the LEDs 27. Strobe circuit 110 includes a pair of transistors Q6 and Q7 that switch the LEDs 27 on and off. In some embodiments, only a single one of Q6 or Q7 may be used.

Figure 18:
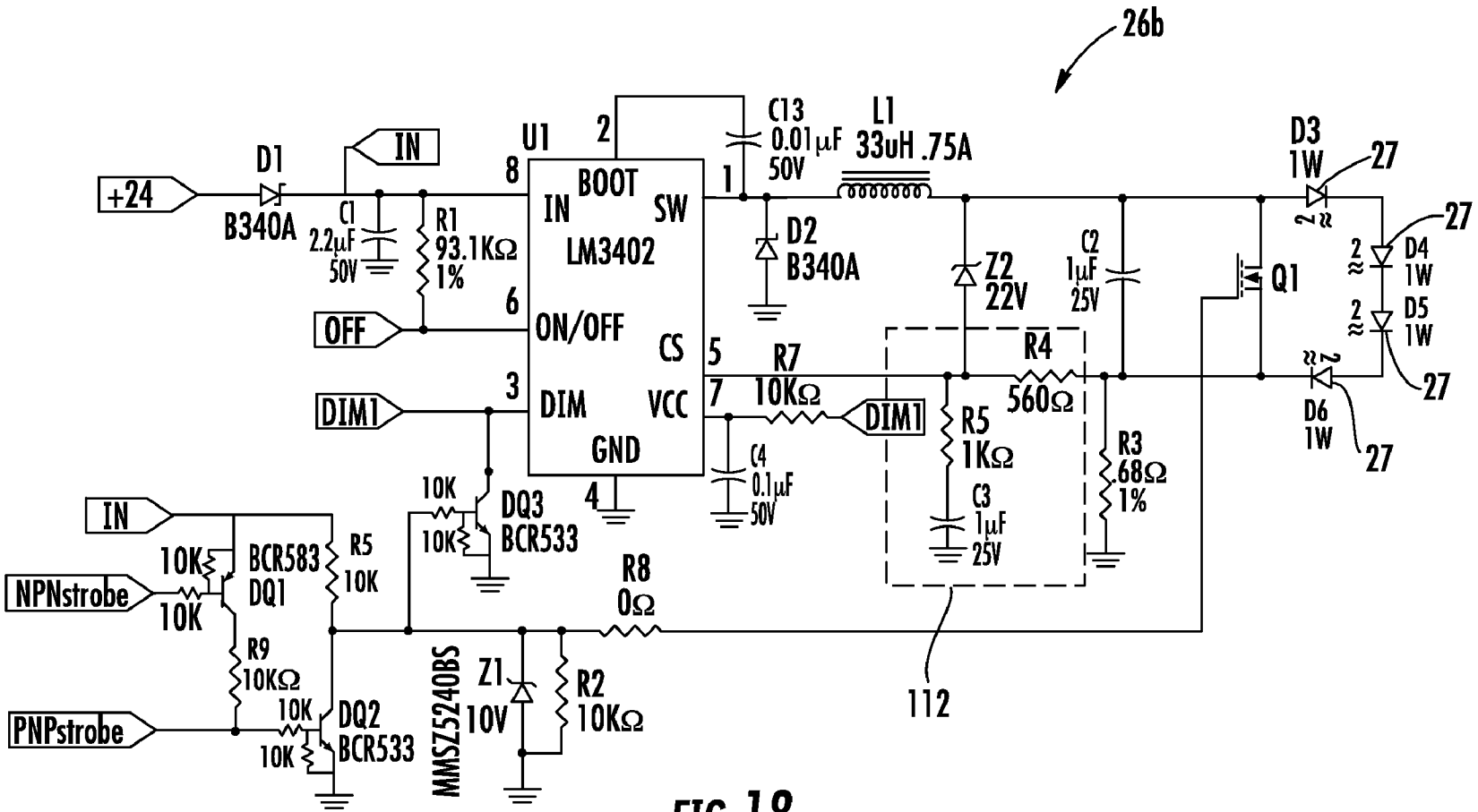
FIG. 18 is an electrical schematic of another LED driver according to another aspect of the present invention that may be used alone or in combination with the LED driver controllers of FIG. 1 or 2.

The electrical schematic for another LED driver 26*b* according to the present invention is depicted in FIG. 18. LED driver 26*b* may be strobed by way of control unit 24, or it may be strobed by way of another external device. If operating under the strobe signals provided by control unit 24, the PNPStrobe line of FIG. 18 would be electrically coupled via an appropriate connector to the selected line of bus 30, in a similar manner to that described above with respect to LED driver 26*a*. If operating according to strobe signals provided by a device other than control unit 24, then the strobe signals of that device would be fed directly into either the PNPStrobe line or the NPNSTrobe line of FIG. 18, depending upon whether the external device supplied NPN or PNP type strobe signals.

The strobe signal received by driver 26*b* from either of the PNPStrobe or NPNStrobe lines is fed through one of transistors DQ1 or DQ2 before being fed through a third transistor DQ3. All three transistors DQ1-3 have built-in bias resistors. The collector of DQ3 is electrically coupled to a DIM pin on an integrated circuit containing a buck converter U1. The buck converter U1 may be a model LM3402 or Model LM3404 Constant Current Buck Regulator circuit marketed by National Semiconductor of Santa Clara, Calif., or it may be a different type of buck converter or other converter circuit. The buck converter circuit U1 includes eight pins, one of which is an on/off pin (pin 6), and another of which is a DIM pin (pin 3). Pin 6 is configured to turn on and off the buck converter U1. The DIM pin is configured, according to the manufacturer of circuit U1, to receive a pulse width modulated signal whose duty cycle affects the brightness of LEDs 27. LED driver 26*b*, however, is configured such that DIM pin 3 will receive a strobe input from a camera or other trigger rather than a pulse width modulated signal. LED driver 26*b* therefore controls the strobing on and off of the LEDs 27 by using the DIM pin (pin 3) rather than the on/off pin (pin 6) of buck converter U1. This enables the driver 26*b* to more quickly turn on or off the LEDs 27 in response to a strobe signal received from either of the PNPStrobe or NPNStrobe inputs. In fact, in the circuit diagram illustrated in FIG. 18, the driver 26*b* is capable of turning on the LEDs 27 within 10-18 microseconds after receiving a strobe input at DIM pin 3.

Figure 9:
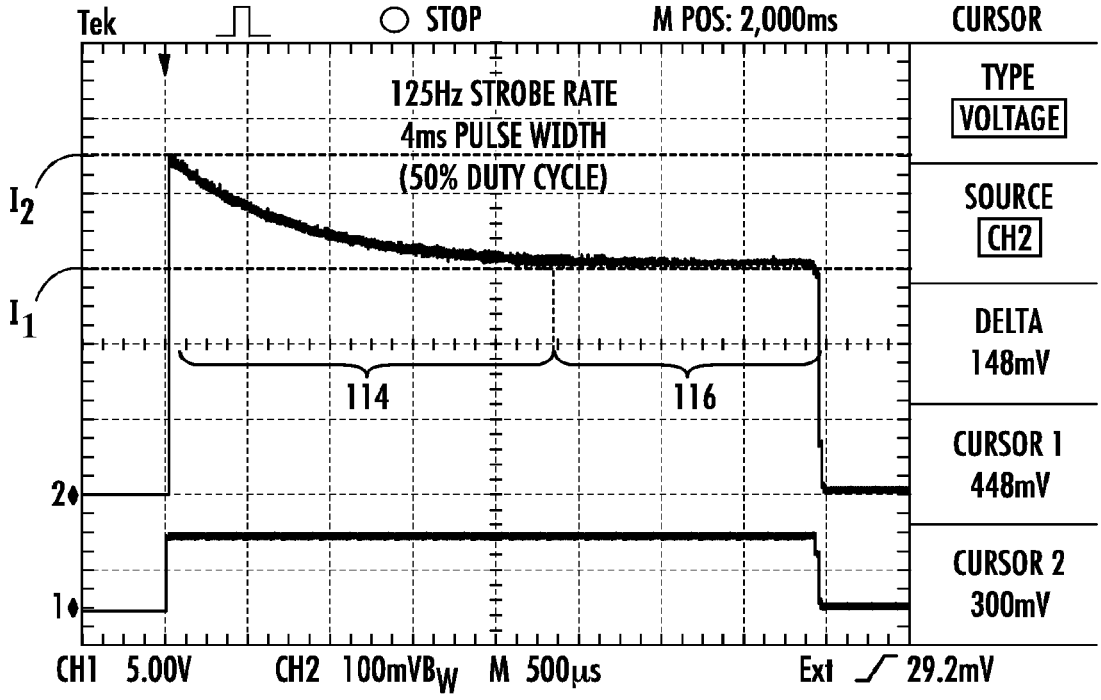
FIG. 9 is a printout of an output waveform supplied by an LED driver, such as that shown in FIG. 18 or FIG. 20, to one or more LEDs.

LED driver 26*b* includes a current boosting circuit 112 that allows the LEDs 27 to be temporarily driven at a current level that is greater than their maximum forward continuous rating. The current boost that is generated by boost circuit 112 is illustrated in the waveform of FIG. 9. FIG. 9 shows the strobe input on channel 1 and the output to the LEDs on channel 2. Further, it shows the maximum continuous forward current rating $I_1$ for the LED, as well as the maximum overdrive current $I_2$ for the LED. As can be seen, the boost circuit 112 will cause the current supplied to the LEDs 27 to temporarily rise up to $I_2$ and then gradually decrease back to $I_1$. The amount of time it takes for this decrease back to $I_1$ is labeled as a time period 114 in FIG. 9. A second time period 116 indicates the amount of time after the first time period 114 has passed during which a non-zero current is supplied to the LEDs 27.

Boost circuit 112 allows for the brightest possible lighting to be provided by LEDs 27 without damaging the LEDs 27. A photograph taken at any time within the time frame defined by time period 114 will have more illumination than photographs taken outside that time period because the LEDs 27 will have more current flowing through them.

Time period 114 can be adjusted by adjusting the components of boost circuit 112. Specifically, the amount of current boost (i.e. the amplitude of $I_2$) and the time for it to decrease back to amplitude $I_1$ can be adjusted by adjusting the values of capacitor C3 and resistor R5, as would be understood by one skilled in the art. This will also change second time period 116. Second time period 116 can also be changed by entering a different data field into the "on time" data field in the screen shot 52 of FIG. 8.

Driver circuit 26*b* is powered by an external twenty four volt power supply that is fed into a diode D1, which acts as a reverse polarity protection device. This reverse polarity protection device could be replaced by the low loss reverse polarity protection circuit 108 discussed above with respect to driver 26*a*, if desired. The switching on and off of the LEDs 27 by driver 26*b* can be accomplished in two different configurations. In a first configuration, transistor Q1 is used and transistor DQ3 is removed (left open-circuited) along with capacitor C2. When operated using this configuration, LED driver 26*b* is not capable of providing the current boost of boost circuit 112 discussed above. In a second configuration, transistor Q1 is removed and transistor DQ3 is inserted (as shown in FIG. 18), along with capacitor C2. Zener diode Z1 and resistor R2 are removed. In this second configuration, drive 26*b* is capable of providing the current boost of boost circuit 112.

FIG. 20 illustrates an alternative LED driver 26*c*. LED driver 26*c* is generally similar to LED driver 26*b* with the primary exception of LED driver 26*c* including brightness control circuitry 122. Brightness control circuitry 122 allows a user of LED driver 26*c* to control the brightness level of the one or more LEDs 27 being powered by LED driver 26*c*. Brightness control circuitry 122 controls the brightness of the LEDs 27 by changing the amount of current that flows through the LEDs 27. In the embodiment illustrated in FIG. 20, brightness control circuitry 122 allows for both manual and automated control of the brightness of the LEDs 27.

The manual control of the brightness of LEDs 27 is accomplished by a user physically adjusting potentiometer V1 (FIG. 20). The adjustment of potentiometer V1 causes the voltage supplied to resistor R11 to change. This, in turn, affects the voltage at point P1. Integrated circuit U1, however, is configured such that it will automatically attempt to maintain an approximately constant voltage at point P1 (as sensed by the CS pin—pin 5—of integrated circuit U1). Integrated circuit U1 maintains this approximately constant voltage by altering the duty cycle of the current supplied to LEDs 27, as is described in greater detail in the manufacturer's data sheet for the National Semiconductor integrated circuit model LM3402, the complete disclosure of which is hereby expressly incorporated herein by reference. The net result of this changed duty cycle is to alter the current supplied to LEDs 27, and thus change their brightness.

As can be seen in FIG. 20, potentiometer V1 is connected to pin Vcc of integrated circuit U1. In one embodiment, pin Vcc may output a voltage of approximately seven volts, although the precise voltage can vary from embodiment to embodiment. When potentiometer V1 is set such that substantially the full voltage of Vcc is applied to diode D7, driver 26*c* will drive the LEDs 27 at their dimmest state which, in one embodiment, may be entirely off. When potentiometer V1 is set such that one end of diode D7 is effectively grounded, then driver 26*c* will drive the LEDs 27 at the brightest state to which driver 26*c* is configured to drive them. When potentiometer V1 is set between these two extremes, of course, the brightness of LEDs 27 will vary in a corresponding manner between their brightest and least bright states.

In addition to the ability to manually control the brightness of LEDs 27 via potentiometer V1, LED driver 26*c* includes the ability to control the brightness of the LEDs 27 automatically. This may be accomplished through a control signal applied to resistor R12. In the embodiment illustrated in FIG. 20, the control signal may vary between zero and ten volts. It will be understood, however, that the precise range of voltages that may be used for the control signal can vary. When the voltage of the control signal applied to resistor R12 is at its highest level (such as, but not limited to, ten volts), LED driver 26*c* will drive LEDs 27 at their lowest brightness level (which, in some embodiments, may be completely off). When the voltage of the control signal applied to resistor R12 is at its lowest level (e.g. zero volts), LED driver 26*c* will drive LEDs 27 at their highest brightness level. Control signals having voltage levels between the highest and lowest levels will cause driver 26*c* to drive LEDs 27 at intermediate levels of brightness. Accordingly, the brightness of LEDs 27 may be controlled by applying a voltage at a particular level to resistor R12.

As is further shown in FIG. 20, a voltage applied to resistor R12 will tend to increase the voltage at point P1 in generally the same manner as a high voltage coming from potentiometer V1 (as discussed above). Integrated circuit U1 will respond to this raised voltage at point P1 (as detected via CS pin 5) by reducing the current delivered to LEDs 27. As a result, different voltages applied to resistor R12 will yield different brightness levels for LEDs 27.

Brightness control circuitry 122 of LED driver 26*c* has the additional advantage of being able to adjust the brightness levels of different sets of LEDs 27 so that they match. In other words, suppose a first LED driver 26*c* is being used to control a first set of LEDs 27 and a second LED driver 26*c*' is being used to control a second set of LEDs 27'. In some instances, it may be desirable to have the brightness level of the LEDs in each set (27 and 27') precisely match each other. While applying the same voltage level to each of the resistors R12 in each of the drivers 26*c* and 26*c*' would tend to generate brightness levels that are comparable in each set of LEDs 27 and 27', there may be variations in the brightness between the two sets because one set may have LEDs produced by a different manufacturer, or one set may have LEDs that are of a different age, or one set may have other characteristics that cause its LEDs to have a different brightness level than the other set, despite the common voltage being applied to each of resistors R12. In order to fine tune the brightness of one of the sets so that it matches the brightness of the other set, potentiometer V1 can be physically moved until the brightness of each set precisely matches. Once this initial adjustment to potentiometer V1 is made, the LEDs 27 and 27' in each set will generate the same brightness whenever they receive a common brightness signal at resistor R12.

While the present invention has been described in terms of the embodiments discussed in the above specification, it will be understood by one skilled in the art that the present invention is not limited to these particular embodiments, but includes any and all modifications that are within the spirit and scope of the present invention that is defined in the appended claims.

What is claimed is:

1. An LED driver for driving at least one LED wherein said at least one LED has a forward current rating and a surge rating that are provided by a manufacturer of the LED, said forward current rating identifying a maximum amount of current that is able to continuously run through said LED without damaging the LED, and said surge rating identifying an amount of current that is able to run through said LED for a specified amount of time before damaging said LED, said surge current rating being higher than said forward current rating, said LED driver comprising:

a constant current regulating circuit adapted to control a constant current at an output, said output being adapted for coupling directly to at least one LED;

a strobe circuit coupled to said constant current regulating circuit, said strobe circuit having an input, said strobe circuit adapted to control said constant current regulating circuit such that said constant current regulating circuit sets a constant current at said output when said strobe circuit detects a change in voltage at said input;

a current boosting circuit coupled to said constant current regulating circuit, said current boosting circuit adapted to change the constant current at said output wherein said change comprises:

elevating the current at said output to a value above the forward current rating for a first period of time, said first period of time being no greater than said specified amount of time; and lowering the current at said output after said first period of time to a non-zero value no greater than said forward current rating for a second period of time.

2. The driver of claim 1 wherein said current boosting circuit includes a capacitor having a capacitance value and a resistor having a resistance value, said current boosting circuit adapted to change a duration of said first period of time by changing said capacitance value or said resistance value.

3. The driver of claim 1 wherein said constant current regulating circuit is an integrated circuit integrated onto a single chip having a plurality of connector pins.

4. The driver of claim 3 wherein a first one of said connector pins is an on/off control adapted to turn said constant current regulating circuit on or off, and a second one of said connector pins is a dimming control adapted to control a value of the constant current at said output, said strobe circuit being adapted to turn on and off current at said output by adjusting a voltage at said second one of said connector pins while maintaining a sufficient voltage at said first connector to keep said constant current regulating circuit on.

5. The driver of claim 1 wherein said strobe circuit and said constant current regulating circuit are adapted to set said constant current at said output within twenty microseconds after said strobe circuit detects a change in voltage at said input.

6. The driver of claim 1 further including an output voltage limiter, said output voltage limiter adapted to prevent a voltage at said output from exceeding a predetermined value.

7. The driver of claim 1 further including a power input for coupling a power source to said driver to power said driver, said power input including a reverse polarity protection circuit adapted to prevent damage to said driver if said power source is coupled to said power input with an incorrect polarity.

* * * * *